US007793377B2

(12) United States Patent
Knopow et al.

(10) Patent No.: US 7,793,377 B2
(45) Date of Patent: Sep. 14, 2010

(54) CONTINUOUS ADHESIVE ROLLER

(75) Inventors: Jeremy F. Knopow, Burlington, WI (US); Steven A. Zach, Racine, WI (US); Michael J. Maloney, Madison, WI (US); Jonathan M. Mick, Marshall, WI (US); Kevin L. Askling, Madison, WI (US); Thomas A. Sutrina, Rockford, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 1189 days.

(21) Appl. No.: 11/403,306

(22) Filed: Apr. 13, 2006

(65) Prior Publication Data

US 2006/0254017 A1 Nov. 16, 2006

Related U.S. Application Data

(60) Provisional application No. 60/672,156, filed on Apr. 15, 2005, provisional application No. 60/692,411, filed on Jun. 21, 2005.

(51) Int. Cl.
*A47L 25/00* (2006.01)

(52) U.S. Cl. ..... 15/104.002; 15/250.22; 15/230.11

(58) Field of Classification Search ..... 15/104.002, 15/230.11, 105, 250.22; 492/13, 19
See application file for complete search history.

(56) References Cited

U.S. PATENT DOCUMENTS

| | | | |
|---|---|---|---|
| 277,173 | A | 5/1883 | Thompson |
| 671,296 | A | 4/1901 | Rowand |
| 1,403,817 | A | 1/1922 | Pinson |
| 1,497,035 | A | 6/1924 | Skoalund |

(Continued)

FOREIGN PATENT DOCUMENTS

| | | |
|---|---|---|
| EP | 0586036 | 3/1994 |

(Continued)

OTHER PUBLICATIONS

International Search Report, PCT/US2006/013819, completed Feb. 13, 2007.

*Primary Examiner*—Dung Van Nguyen

(57) ABSTRACT

A device (20) for cleaning surfaces is provided utilizing a web (94) of a tackified sheet material movably secured between rollers (56, 58) on the device (20) that enable the web (94) to be moved over the surface in opposite directions. The device (20) includes a supply roller (56) and a take-up roller (58) secured to opposed ends of the web (94) of adhesive sheet material, with at least one roller (56, 58) including a biasing mechanism (82) disposed within the roller (56, 58). The web (94) can be engaged with the surface by passing over a number of idler rollers (98) positioned between the supply roller (56) and take-up roller (58). The biasing mechanism (82) is designed to bias the movement of the web (94) onto the take-up roller (58), such that the mechanism (82) can be selectively operated to advance the web (94) from the supply roller (56) to the take-up roller (58) to expose a clean section of the adhesive sheet material (94). A mechanism (41) is also connected between the rollers (56, 58) to enable the rollers (56, 58) to rotate in a synchronous manner, regardless of the amount of the web (94) that is positioned on the rollers (56, 58) to continually tension the web (94) a proper amount.

8 Claims, 14 Drawing Sheets

U.S. PATENT DOCUMENTS

| | | | | |
|---|---|---|---|---|
| 1,583,606 | A | | 5/1926 | Roussel |
| 1,783,788 | A | | 12/1930 | Hatchett, Sr. |
| 2,034,169 | A | | 3/1936 | Alefantis |
| 2,101,027 | A | | 12/1937 | Karoer |
| 2,103,455 | A | | 12/1937 | Greenwald |
| 2,550,092 | A | | 4/1951 | Sitek |
| 2,651,071 | A | | 9/1953 | Dyer et al. |
| 2,702,913 | A | | 3/1955 | Walkama |
| 2,715,742 | A | | 8/1955 | Coles |
| 2,724,847 | A | | 11/1955 | Krasno |
| 2,828,501 | A | | 4/1958 | Brown, Sr. |
| 3,056,154 | A | | 10/1962 | Neal |
| 3,103,029 | A | | 9/1963 | Valles |
| 3,151,333 | A | | 10/1964 | Scholz |
| 3,321,790 | A | | 5/1967 | Hand |
| 3,330,077 | A | | 7/1967 | Kanbar et al. |
| 3,389,416 | A | | 6/1968 | Timms |
| 3,471,977 | A | | 10/1969 | Roth |
| 3,643,386 | A | | 2/1972 | Grzyll |
| 3,742,547 | A | | 7/1973 | Sohmer |
| 3,747,152 | A | | 7/1973 | Tsuruzawa |
| 3,772,722 | A | | 11/1973 | Gellert |
| 3,883,921 | A | | 5/1975 | Thettu et al. |
| 3,885,249 | A | | 5/1975 | De Brabander |
| 3,906,578 | A | | 9/1975 | Huber |
| 3,967,338 | A | | 7/1976 | Russell |
| 3,982,298 | A | | 9/1976 | Ota |
| 4,038,787 | A | | 8/1977 | Bianchi |
| 4,042,995 | A | | 8/1977 | Varon |
| 4,062,083 | A | | 12/1977 | McKay |
| 4,103,382 | A | | 8/1978 | Gitt |
| 4,107,840 | A | | 8/1978 | Kupperman et al. |
| D251,022 | S | | 2/1979 | McKay |
| 4,225,997 | A | | 10/1980 | Thomas et al. |
| 4,294,597 | A | | 10/1981 | Archer et al. |
| 4,361,923 | A | | 12/1982 | McKay |
| 4,399,579 | A | | 8/1983 | McKay |
| 4,422,201 | A | | 12/1983 | McKay |
| 4,427,726 | A | | 1/1984 | Wolfrum |
| D273,058 | S | | 3/1984 | McKay |
| D273,059 | S | | 3/1984 | McKay |
| D276,763 | S | | 12/1984 | McKay |
| 4,510,642 | A | * | 4/1985 | Ingermann et al. ..... 15/231 |
| 4,550,467 | A | * | 11/1985 | Johnson et al. ..... 15/228 |
| 4,557,011 | A | | 12/1985 | Sartori |
| 4,562,610 | A | * | 1/1986 | Davis et al. ..... 15/228 |
| 4,570,280 | A | | 2/1986 | Roth |
| 4,575,890 | A | | 3/1986 | Hidle |
| 4,593,427 | A | | 6/1986 | Ortolivo |
| 4,621,388 | A | | 11/1986 | Ortolivo |
| 4,640,539 | A | * | 2/1987 | La Porte ..... 294/19.1 |
| 4,642,835 | A | | 2/1987 | Schmitz |
| 4,670,930 | A | | 6/1987 | Lu |
| 4,703,538 | A | | 11/1987 | Silverstrone |
| 4,713,274 | A | | 12/1987 | Minor |
| 4,727,616 | A | | 3/1988 | Kucera et al. |
| D295,833 | S | | 5/1988 | Roth |
| 4,797,967 | A | | 1/1989 | Lengers |
| 4,847,937 | A | | 7/1989 | Gorski |
| 4,850,073 | A | | 7/1989 | Preuss |
| 4,884,374 | A | | 12/1989 | Natale et al. |
| 4,905,337 | A | | 3/1990 | McKay |
| 4,979,257 | A | | 12/1990 | Heneveld |
| 4,980,943 | A | | 1/1991 | Barber |
| 5,008,969 | A | | 4/1991 | Jarrett |
| 5,009,195 | A | | 4/1991 | Damm |
| 5,010,617 | A | | 4/1991 | Nelson |
| D317,083 | S | | 5/1991 | Chou |
| 5,027,465 | A | | 7/1991 | McKay |
| 5,036,561 | A | | 8/1991 | Calafut |
| 5,134,746 | A | | 8/1992 | William |
| 5,148,571 | A | | 9/1992 | Brazis et al. |
| D341,256 | S | | 11/1993 | Brazis et al. |
| 5,280,664 | A | | 1/1994 | Lin |
| 5,333,341 | A | | 8/1994 | Heneveld |
| 5,419,014 | A | | 5/1995 | Piantedosi |
| 5,441,355 | A | | 8/1995 | Moore |
| D362,965 | S | | 10/1995 | Tastanis |
| 5,524,575 | A | | 6/1996 | Lennon |
| 5,525,397 | A | | 6/1996 | Shizuno et al. |
| 5,553,344 | A | | 9/1996 | Rosenkrantz |
| 5,569,521 | A | | 10/1996 | Francoeur, Sr. et al. |
| 5,577,273 | A | | 11/1996 | Newkirk et al. |
| 5,600,865 | A | | 2/1997 | Morrison |
| D384,058 | S | | 9/1997 | Pinon |
| 5,673,435 | A | | 10/1997 | Gebhard |
| 5,682,837 | A | | 11/1997 | Courtney et al. |
| 5,742,969 | A | | 4/1998 | Thomas et al. |
| 5,763,038 | A | | 6/1998 | Wood |
| 5,768,709 | A | | 6/1998 | Newkirk et al. |
| 5,783,034 | A | | 7/1998 | Urso |
| 5,829,089 | A | | 11/1998 | Steadman |
| 5,878,439 | A | | 3/1999 | Waters, Jr. |
| 5,878,457 | A | | 3/1999 | Cox et al. |
| 5,894,623 | A | | 4/1999 | Thill |
| D411,048 | S | | 6/1999 | Pinon |
| 5,922,427 | A | | 7/1999 | King |
| 5,924,157 | A | | 7/1999 | Barela |
| 5,956,770 | A | | 9/1999 | Dennis |
| D417,551 | S | | 12/1999 | Pinchuk |
| 6,014,788 | A | | 1/2000 | Jaffri |
| 6,016,571 | A | | 1/2000 | Guzman et al. |
| 6,021,542 | A | | 2/2000 | Norman |
| 6,024,970 | A | | 2/2000 | Woodard |
| 6,055,695 | A | | 5/2000 | McKay, Jr. |
| 6,109,214 | A | | 8/2000 | Rampersad |
| 6,127,014 | A | | 10/2000 | McKay, Jr. |
| 6,192,543 | B1 | | 2/2001 | Lee |
| D439,387 | S | | 3/2001 | Ancona et al. |
| 6,233,854 | B1 | | 5/2001 | Levy et al. |
| 6,241,580 | B1 | | 6/2001 | Fisher |
| D446,368 | S | | 8/2001 | Pizarro |
| 6,292,948 | B1 | | 9/2001 | Chen |
| 6,298,517 | B1 | | 10/2001 | McKay |
| 6,305,843 | B1 | | 10/2001 | Helmer |
| 6,319,478 | B1 | | 11/2001 | McKay, Jr. |
| 6,343,397 | B1 | | 2/2002 | Odagiri |
| 6,405,403 | B1 | | 6/2002 | McKay |
| 6,425,136 | B1 | | 7/2002 | Schlamp et al. |
| 6,427,278 | B1 | | 8/2002 | McKay, Jr. |
| 6,427,633 | B1 | | 8/2002 | Ogden |
| D463,134 | S | | 9/2002 | Vosbikian |
| 6,449,794 | B1 | | 9/2002 | Jaffi |
| 6,460,191 | B1 | | 10/2002 | Lorkovic |
| D467,736 | S | | 12/2002 | Russell |
| D468,540 | S | | 1/2003 | Jessen |
| 6,530,108 | B1 | | 3/2003 | Brown et al. |
| 6,557,178 | B1 | | 5/2003 | Hoover |
| 6,560,813 | B2 | | 5/2003 | Brown et al. |
| 6,576,323 | B2 | | 6/2003 | Wise et al. |
| D483,570 | S | | 12/2003 | Heidel et al. |
| D483,952 | S | | 12/2003 | Thompson et al. |
| 6,687,942 | B1 | | 2/2004 | Pember |
| 6,688,464 | B2 | | 2/2004 | Jessen et al. |
| 6,698,626 | B2 | | 3/2004 | McKay |
| 6,735,806 | B2 | * | 5/2004 | Blum et al. ..... 15/104.002 |
| D490,952 | S | | 6/2004 | Ajluni |
| 6,763,977 | B2 | | 7/2004 | McKay |
| 6,783,600 | B2 | | 8/2004 | Tawara et al. |
| 6,829,802 | B2 | | 12/2004 | McKenzie |
| 6,834,619 | B1 | | 12/2004 | Rampersad |
| 6,842,934 | B1 | | 1/2005 | McKay, Jr. et al. |
| 7,003,840 | B2 | | 2/2006 | Tawara et al. |
| 7,020,926 | B2 | | 4/2006 | McKay |

| | | | |
|---|---|---|---|
| 7,039,982 | B1 | 5/2006 | McKay |
| 7,047,586 | B2 | 5/2006 | Shimada et al. |
| 7,047,587 | B2 | 5/2006 | Heidel |
| 7,060,337 | B2 | 6/2006 | Williamson |
| 7,107,643 | B1 | 9/2006 | McKay |
| 7,111,351 | B1 | 9/2006 | DeRoma |
| 7,395,574 | B2 | 7/2008 | McKay |
| 7,413,786 | B2 | 8/2008 | Wada et al. |
| 2002/0078488 | A1 | 6/2002 | Lorkovic |
| 2002/0124335 | A1 | 9/2002 | Franko, Sr. |
| 2002/0144367 | A1 | 10/2002 | McKay, Jr. |
| 2002/0157977 | A1 | 10/2002 | Reid-Killings et al. |
| 2003/0039822 | A1 | 2/2003 | Aalbers |
| 2003/0049407 | A1 | 3/2003 | Kacher et al. |
| 2003/0089632 | A1 | 5/2003 | Jessen et al. |
| 2003/0096074 | A1 | 5/2003 | Kim |
| 2003/0135941 | A1 | 7/2003 | Vosbikian |
| 2003/0154569 | A1 | 8/2003 | McKay |
| 2003/0209564 | A1 | 11/2003 | McKay |
| 2003/0209565 | A1 | 11/2003 | McKay |
| 2003/0229958 | A1 | 12/2003 | Thompson et al. |
| 2004/0034952 | A1 | 2/2004 | Ho et al. |
| 2004/0052570 | A1 | 3/2004 | McKay |
| 2004/0134003 | A1 | 7/2004 | McKay, Jr. |
| 2004/0177459 | A1 | 9/2004 | McKay |
| 2004/0177461 | A1 | 9/2004 | Ajluni |
| 2004/0182886 | A1 | 9/2004 | McKay |
| 2004/0194240 | A1 | 10/2004 | McKay, Jr. |
| 2005/0026759 | A1 | 2/2005 | McKay, Jr. et al. |
| 2005/0188485 | A1 | 9/2005 | McKay |
| 2005/0217045 | A1 | 10/2005 | Minkler et al. |
| 2005/0241088 | A1 | 11/2005 | Brunner et al. |
| 2005/0241089 | A1 | 11/2005 | Brunner et al. |
| 2006/0112507 | A1 | 6/2006 | McKay |
| 2006/0121232 | A1 | 6/2006 | McKay |
| 2006/0225233 | A1 | 10/2006 | McKay |
| 2007/0220691 | A1 | 9/2007 | McKay |
| 2008/0040874 | A1 | 2/2008 | McKay |

FOREIGN PATENT DOCUMENTS

| | | | |
|---|---|---|---|
| EP | 0966915 | | 12/1999 |
| EP | 0969758 | A1 | 1/2000 |
| EP | 0969758 | B1 | 1/2000 |
| EP | 0969758 | B1 | 3/2003 |
| GB | 2103074 | | 2/1983 |
| GB | 2103470 | | 2/1983 |
| GB | 2220841 | | 1/1990 |
| GB | 2263393 | | 1/1992 |
| GB | 2257618 | | 1/1993 |
| GB | 2263393 | | 7/1993 |
| JP | 02071721 | | 3/1990 |
| JP | 05211984 | | 8/1993 |
| JP | 7227375 | A | 8/1995 |
| JP | 10262881 | | 6/1998 |
| JP | 10328123 | | 12/1998 |
| JP | 11253382 | | 9/1999 |
| JP | 2000000202 | | 1/2000 |
| JP | 2000-254090 | | 9/2000 |
| JP | 2000287910 | | 10/2000 |
| JP | 2003000510 | | 1/2003 |
| JP | 2003-250744 | | 9/2003 |
| JP | 2004-298593 | | 10/2004 |
| JP | 2004-329830 | | 11/2004 |
| JP | 2005-253931 | | 9/2005 |
| JP | 2006-006860 | | 1/2006 |
| JP | 2006-130276 | A | 5/2006 |
| WO | WO98/36677 | | 8/1998 |
| WO | WO 00/23535 | | 4/2000 |
| WO | WO0023535 | | 4/2000 |
| WO | WO03/015601 | | 2/2003 |
| WO | WO03/015602 | | 2/2003 |
| WO | WO03015602 | | 2/2003 |
| WO | WO03/041558 | | 5/2003 |
| WO | WO03041558 | | 5/2003 |
| WO | WO03/104119 | | 12/2003 |
| WO | WO03/105656 | | 12/2003 |
| WO | WO03104119 | | 12/2003 |
| WO | WO03105656 | | 12/2003 |
| WO | WO 2004/087825 | | 10/2004 |
| WO | WO2004087825 | | 10/2004 |

* cited by examiner

CONTINUOUS ADHESIVE ROLLER

CROSS-REFERENCE TO RELATED APPLICATIONS

This application claims priority U.S. Provisional Patent Application Ser. No. 60/672,156, filed on Apr. 15, 2005, and U.S. Provisional Patent Application Ser. No. 60/692,411, filed on Jun. 21, 2005, the entities of which are expressly incorporated by reference herein in their entirety.

FIELD OF THE INVENTION

The present invention relates to surface cleaning devices, and more specifically to a surface cleaning device including rollers on which are movably disposed a continuous adhesive web or sheet utilized to pick up dust, lint and other debris from the surface.

BACKGROUND OF THE INVENTION

A number of different surface cleaning devices utilizing adhesive sheets or webs have been developed for cleaning various surfaces. The majority of these devices include a single roller having a sheet of material with a tackified outer surface disposed on the exterior of the roller that is capable of picking up lint, dust and other debris on the surface as the roller is contacted with the surface. As the roller moves along the surface, the tackified surface contacts and adheres to the lint, dust and debris on the surface, thereby lifting the debris off of the surface and onto the roller.

However, with regard to cleaning devices of this type, the roller has a limited number of uses. This is because the adhesive material on the exterior of the roller must be continually cleaned or replaced based on the amount of debris that is adhered to the roller as it moves across the surface.

In order to overcome this shortcoming, other cleaning devices have been developed that include a pair of rollers between which are connected a continuous web of an adhesive sheet material. In these devices, the adhesive sheet material can be advanced from a web supply roller toward a web take-up roller as the device is used in order to provide a number of sequential clean sections of the adhesive sheet web when the previous section has collected a sufficient amount of lint, dust or debris to render the previous section no longer usable. Because the adhesive sheet is continually moved onto the take-up roll and off of the supply roll, the device can readily present a clean section of the adhesive sheet for use in cleaning a surface.

Examples of devices of this type include Hester U.S. Pat. No. 4,083,075 that discloses a lint pickup device that includes a pair of rollers formed as a supply roller and a take-up roller that are disposed within a cartridge and which support a continuous web of an adhesive sheet utilized to clean carpets, rugs and other surfaces of lint. The rollers are connected to one another and to a ratcheting gear mechanism that selectively exposes additional sections of the adhesive material web from the supply roller in order to enable an individual to continuously clean a surface. However, the rollers do not allow for the web to move continuously between the rollers when the device is in use, such that the device cannot be moved continuously over a surface to pickup lint, dust and other debris from the surface.

Blum et al. U.S. Pat. No. 6,735,806 discloses another device of this type including a tacky roller for improved surface cleaning in which a continuous sheet of a tackified web is applied to a surface to clean the surface. The web is supported by a pair of rollers disposed within the device and by a number of contact rollers which maintain the web in contact with the surface to be cleaned as the web moves continuously between the rollers. The device also includes a brush that contacts and provides additional cleaning to the surface.

Still another cleaning device of this type is shown in Plankenhorn U.S. Pat. No. 6,859,976 which discloses a cleaning apparatus with continuous action wiping and sweeping having a continuous web of an adhesive sheet material connected between a supply roller and a take-up roller. The web of the adhesive material is advanced from the supply roller onto the take-up roller by a variety of mechanisms, in order to provide the device with a continually clean tackified portion of the web for cleaning purposes.

However, in each of the prior art devices including a supply roller and a take-up roller supporting an adhesive material web, the mechanisms for advancing the web of adhesive material allows for the advancement of material substantially in one direction, such that the devices cannot be utilized to make multiple passes or swipes over a surface to provide enhanced cleaning of the surface. Also, the prior art devices do not illustrate mechanisms for controlling the rotation of the supply end and take-up rollers that can accommodate the changing amounts of the web disposed on each roller, and the corresponding changing rotational speeds of the rollers, to keep the web properly tensioned at all times.

Therefore, it is desirable to develop a cleaning device utilizing a web of an adhesive or tackified sheet material that allows the material to be passed in a continuous motion over a surface in opposite directions to provide enhanced cleaning to the surface, as well as to be advanced from the supply roller to the take-up roller to provide a clean section of the web when desired. It is also desirable that the device control the rotation of the rollers in a synchronized manner to proper tension the web during use of the device and that the web properly contact the surface to be cleaned.

SUMMARY OF THE INVENTION

According to one aspect of the present invention, a continuous adhesive roller cleaning device is provided in which a supply roller and a take-up roller are rotatably mounted to a hand held housing. One or both of the rollers includes a biasing mechanism that provides tension on a web of an adhesive material extending between the rollers such that the web properly contacts the surface to be cleaned when the device is in use. The biasing mechanism roller(s) biases or tensions the roller(s) at different levels, such that the take-up roller has a spring force greater than that for the supply roller. A braking mechanism is engaged with one of the rollers in order to create generally equal forces acting on the supply roller and the take-up roller while the device is in use. Deactivation of the braking mechanism allows the increased spring force acting on the take-up roller to draw the web of adhesive sheet material off of the supply roller, thereby advancing the web a selected amount to provide a clean, unused section of the web for continued use of the device.

According to another aspect of the present invention, the supply roller and take-up roller are caused to rotate synchronously, or in conjunction with one another when the device is used by a belt tensioning synchronization mechanism secured between the rollers. The synchronization mechanism provides adequate tension to the web extending between the rollers regardless of the relative amounts of the web disposed on each roller, and the corresponding different rotational speeds of the rollers. Also the form of the synchronization mechanism and the biasing mechanism secured to the supply roller and the take-up roller allows for the rollers to freely rotate together in the forward or backward direction. Thus, the device can be utilized to make multiple passes in opposite directions over the same section of a surface to provide increased cleaning efficiency of the surface.

According to still another aspect of the present invention, the device has a construction that includes parts that are quickly and easily removable from the device. Because the rollers are fixedly secured to one another by the web of adhesive sheet material extending between the rollers to form a web cartridge, the removable parts of the device enable supply roller, take-up roller and web of adhesive sheet material to be quickly and easily removed from the device after the entire web of adhesive sheet material has been utilized. The rollers can then be replaced with a new cartridge formed of a supply roller and take-up roller having a clean web of adhesive sheet of material for continued use of the cleaning device.

According to still another aspect of the present invention, a 2-roll lint roller is provided with approximately 30' of adhesive tape on one roll (feed roll) that can be transferred to a second roll (take-up roll) as the devices is used to remove lint, hair, etc. from fabric, carpet, drapery, etc. The user needs to have the ability move the device back-and-forth so that the same area of the tape can be used multiple times and then when the tape is "fouled" with debris, it is transferred to the take-up roll making "fresh" unused tape available.

Because the adhesive tape "sticks" to the surface being cleaned, the "tension force" must be greater then the peel force. Peeling occurs as the take-up roll moves over the line of contact of the cylinder. Because of the tension force, the tape follows the curved surface of the roll as it is being peeled from the surface that is being cleaned. One way to keep the rolls "in tension" is to connect them together using a belt, gears, etc. so that they turn together, but this is confounded by the fact that the diameter of the rolls, and thus the surface speed of the rolls, change due to tape being added or removed.

The invention is a 2-roll lint roller device, where a roll and a shaft are connected together by a belt causing them to rotate at the same speed. The shaft is connected to a second roll by a torsion spring. The torsion of the spring always creates a tension force, that is greater then the peel force, on the tape between the two rolls. The belt transfers the reaction force of the torsion spring to the second roll.

As the 2-roll lint roller device is moved across a surface to be cleaned, adhesive tape on one roll (feed roll) is transferred to a second roll (take-up roll) removing lint, hair, etc. from fabric, carpet, drapery, etc. The direction of travel determines which roll is the feed roll and take-up roll. The user needs to have the ability move the device back-and-forth so that the same area of the tape can be used multiple times and then when the tape is "fouled" with debris, it is transferred to the take-up roll making "fresh" unused tape available. The diameters of the feed roll and take-up roll change as the device is moved across a surface. The feed roll decreases in diameter as the same amount of tape increases the diameter of the take-up roll. Additional diameter increases result from the accumulation of debris on the tape.

The surface speed of the tape fed out and tape taken-up on the feed roll and the take-up roll are identical and maintained by the tension created by the torsion spring. However, due to the difference in diameter the rotational speed of the feed roller and take-up roller are typically different. The shaft in the center of one of the rollers rotates due to the belt driving it at the same rate as the other roller. The difference in the shaft and roller rotational rates winds or unwinds the torsion spring. The difference in the rates is much less then the average rate of rotation.

A means of locking the torsion spring is required to replace the lint rollers. This can be accomplished by a brake being applied to both rolls when the used lint tape is removed and new roll of lint tape is slid over the roll. To maintain the torque in the tension spring, the tape between the rolls must be made tight before the brake is released.

According to still a further aspect of the present invention, the roller can be formed with a housing enclosing both rolls which includes a handle to facilitate the movement of the roller over a surface. The housing also includes one or more idler pulleys around which the adhesive web travels from the supply roller to the take-up roller in order to enhance the contact of the adhesive web with the surface to be cleaned. The supply roller is further positioned within the housing in a recessed position, while the idler rollers and take-up roller extend partially out of the housing in order to ensure that the adhesive web contacts the surface in a desired manner. The position and number of the idler rollers, and the position of the take-up roller can be varied in order to provide various configurations for the continuous adhesive roller in order to maximize the contact of the adhesive web with the surface for a desired use.

Numerous other aspects, features and advantages of the present invention will be made apparent from the following detailed description taken together with the drawing figures.

BRIEF DESCRIPTION OF THE DRAWINGS

The drawings illustrate the best mode currently contemplated for practicing the present invention.

In the drawings.

DETAILED DESCRIPTION OF THE INVENTION

Figure 1:
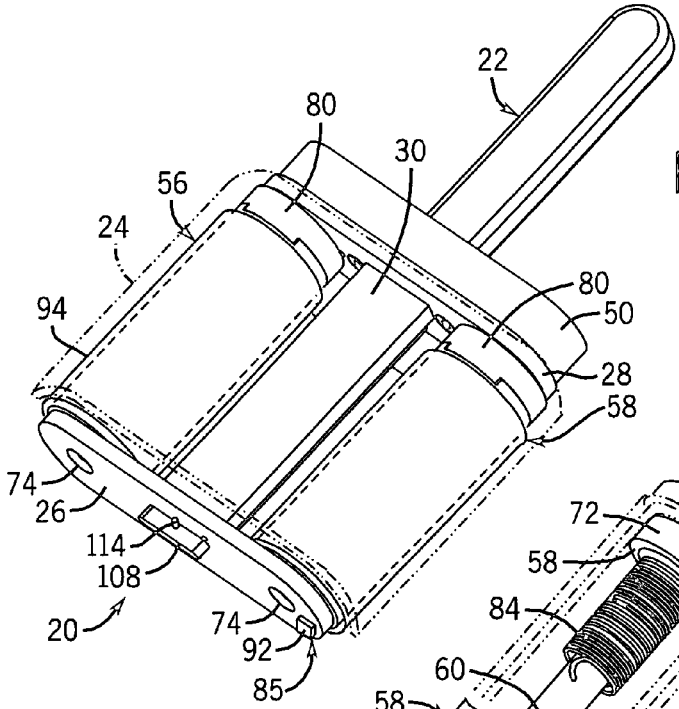
FIG. 1 is an isometric view of the continuous adhesive cleaning device constructed according to the present invention.
Figure 2:
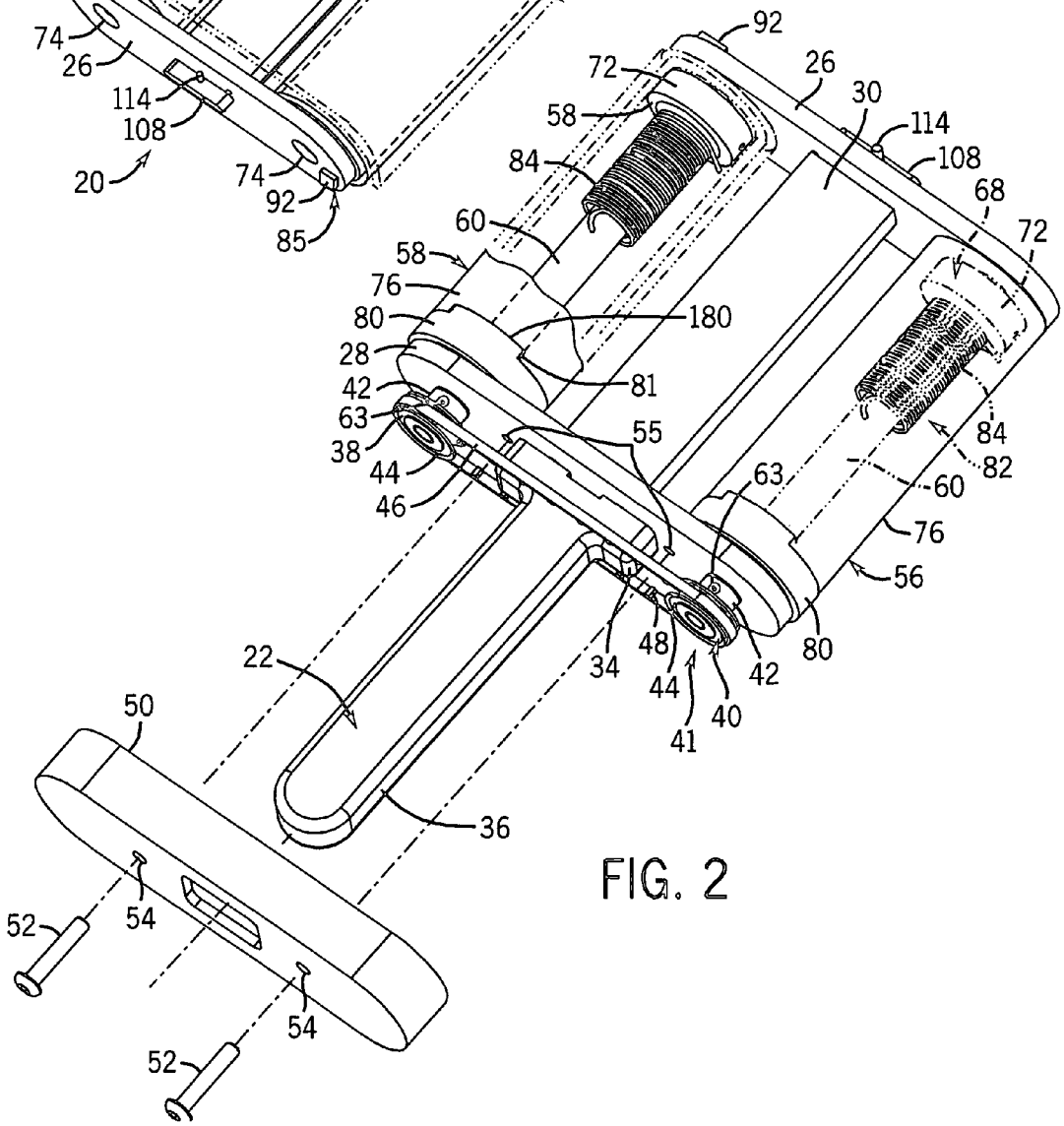
FIG. 2 is a partially exploded, isometric view of the device of FIG. 1 with the protective covered removed.
Figure 3:
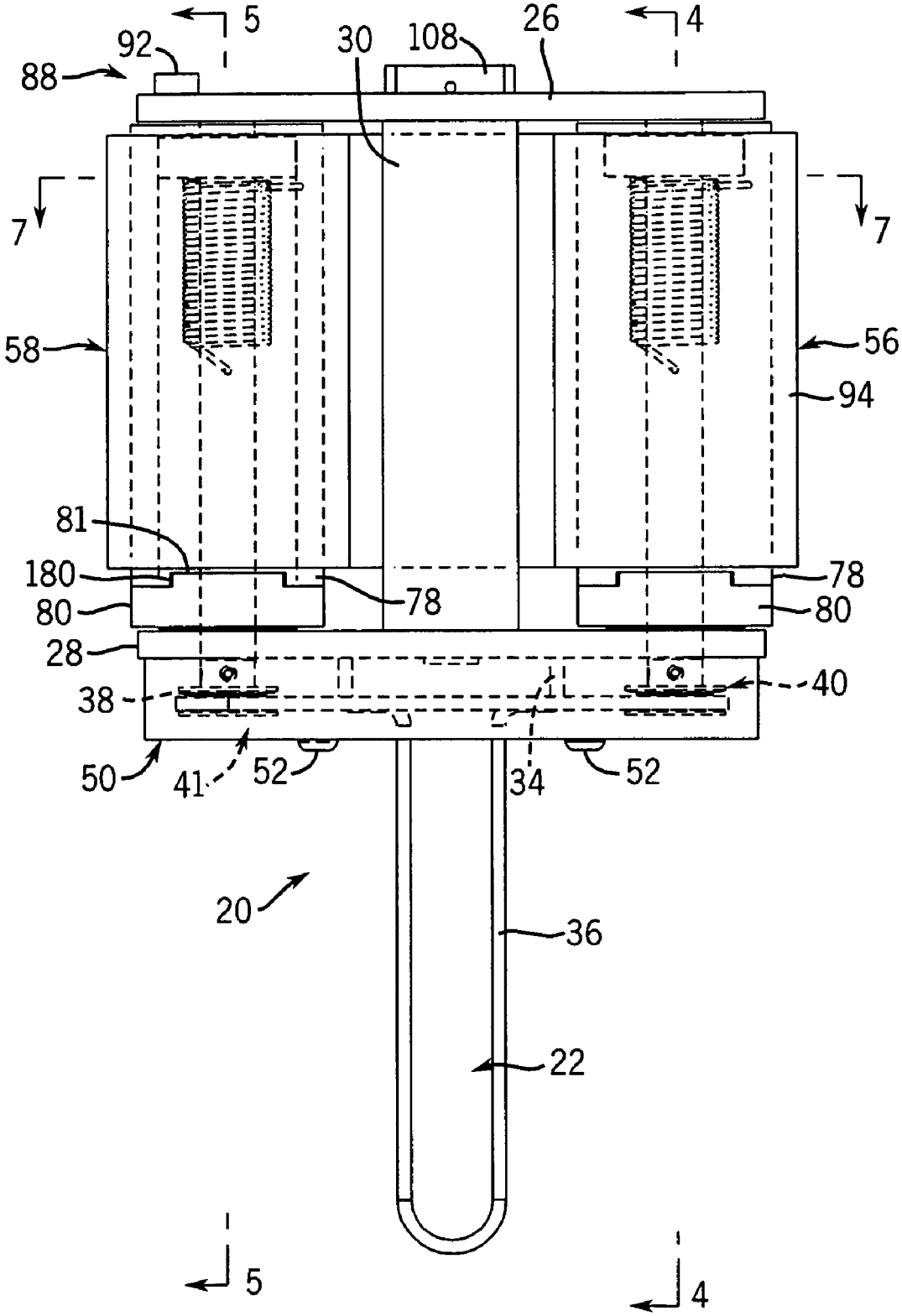
FIG. 3 is a top plan view of the device of FIG. 2.
Figure 4:
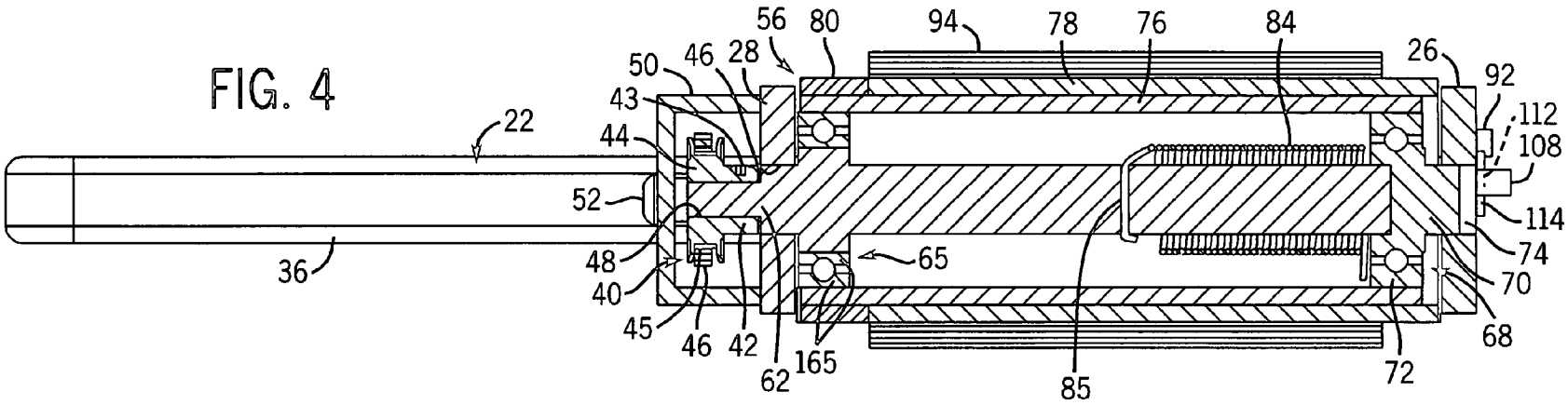
FIG. 4 is a cross-sectional view along line 4-4 of FIG. 3.

With reference now to the drawing figures in which like reference numerals designate like parts throughout the disclosure, a continuous adhesive roller cleaning device constructed according to the present invention is indicated generally at 20 in FIG. 1. The device 20 includes a handle 22 that can be grasped by an individual utilizing the device 20, and a removable cover 24 enclosing the cleaning portions of the device 20.

Upon removing the cover 24, as best shown in FIGS. 2-7, the device 20 includes a front plate 26, a rear plate 28, and a central support 30 extending between and joining the front plate 26 and the rear plate 28. The handle 22 extends rearwardly from and is secured to the rear plate 28 by any suitable mechanism, such as a pair of fasteners 128 extending through a pair of apertures 29 in the rear plate 28 and into a wide base portion 34 of the handle 22. A narrow gripping portion 36 extends outwardly from the base portion 34 away from the rear plate 28 and can be utilized to grasp and move the device 20 over a surface 31 to be cleaned. The central support 30 is secured to the rear plate 28 by a pair of fasteners 130 extending through openings 132 in the rear plate 28 into the central support 30.

The base portion 34 of the handle 22 is secured to the rear plate 28 between a pair of pulleys 38 and 40 rotatably disposed adjacent each side of the rear plate 28 opposite the central support 30 and forming a part of a synchronization mechanism 41. The pulleys 38,40 each include a smaller diameter portion 42 disposed adjacent the rear plate 28, and larger diameter, belt-engaging portion 44 spaced from the rear plate 28 and having a number of peripheral teeth 45. An endless, flexible belt 46 is disposed around each portion 44 of the pulleys 38, 40 and includes teeth 48 that are engaged with the teeth 45 on each outer portion 44 to enable the pulleys 38, 40 to rotate in a synchronized manner with one another. A central opening 48 is defined concentrically within and extends completely through each pulley 38, 40. The pulleys 38, 40 and the endless belt 46 are enclosed on the rear plate 28 within a protective housing 50 secured to and extending outwardly from the rear plate 28 to prevent any interference with the operation of the pulleys 38, 40 and the belt 46. The protective housing 50 is secured to the rear plate 28 in any suitable manner, but preferably by a pair of fasteners 52 which extend through sleeves 54 formed in the cover plate 50. The sleeves 54 are in alignment with apertures 55 in the rear plate 28 such that the fasteners 52 are directly engaged with the rear plate 28.

The device 20 also includes a supply roller 56 and a take-up roller 58 rotatably mounted between the front plate 26 and the rear plate 28. Each roller 56 and 58 includes an inner shaft or spindle 60 having a first end 62 that is inserted through one of a pair of apertures 64 in the rear plate 28 and into the central opening 48 formed in one of the pair of pulleys 38, 40. The first end 62 of each spindle 60 is fixed in a suitable manner within the aligned opening 49, such as by a locking screw 63 inserted through the portion 42 into engagement with the first end 62, for example. The spindles 60 in each roller 56, 58 rotate in a synchronized manner with the pulleys 38, 40 and with one another due to the connection of the pulleys 38, 40 by the belt 46. The first end 62 also includes a spacer bearing 65 rotatably disposed around the first end 62. The spacer bearing 65 defines a central opening 66 which the first end 62 is positioned, and is formed to be generally circular in shape. The central opening 66 in the spacer bearing 65 is formed within an inner portion 165 affixed to the first end 62, and an outer portion 166 is rotatably affixed to the inner portion 165.

Each spindle 60 also includes a second end 67 that is rotatably positioned within another spacer bearing 68. The spacer bearing member 68 is formed similarly to bearing 65 and includes an inner portion 70 fixed to the second end 67 and an outer portion 72 rotatably mounted to the inner portion 70. The inner portion 70 of each spacer bearing 68 is rotatably received within one of a pair of apertures 74 spaced adjacent opposite ends of the front plate 26. Alternatively, the second end 67 of each spindle 60 can extends through the inner portion 70 and to be rotatably received within one of the pair of apertures 74.

The outer portion 166 and the outer portion 72 of each spacer bearing 65, 68 have an outer diameter approximately equal to one another in order to enable a generally cylindrical outer shaft 76 for the rollers 56, 58 to be secured between the outer portions 166, 72 of each spacer bearing 65, 68. The connection of the outer shafts 76 between the outer portions 166, 72 of the spacer bearings 65, 68 enables the outer shafts 76 to rotate around and independently of the spindles 60.

The outer shafts 76 are generally cylindrical in shape in order to allow web-carrying sleeves 78 of a web cartridge 79 to be mounted around the outer shafts 76. The sleeves 78 are engaged with the outer shafts 76 by mounting rings 80 secured to the exterior of outer shafts 76 near the rear plate 28. The mounting rings 80 each include a member of keys 81 that extend outwardly from the rings 80 and that are releasably engageable within notches 180 formed in the sleeves 78 in a manner that enables the sleeves 78 to rotate in conjunction with the outer shafts 76. Further, the engagement between the rings 80 and the sleeves 78, while being sufficient to enable the sleeves 78 to rotate with the outer shafts 76, also allows the sleeves 78 to be easily disengaged from the rings 80 when the sleeves 78 and cartridge 79 are to be removed from the rollers 56, 58 for replacement. The sleeves 78 each are attached to and support one end of a web 94 of an adhesive sheet material that extends from the supply roller 56 and across the width of the device 20 to the take-up roller 58. The web 94 can be formed of any suitable material and includes an outwardly facing tackified surface 96.

Referring now to FIGS. 2-6, between the spindle 60 and the outer shaft 76, each roller 56 and 58 also includes a biasing mechanism 82. The mechanism 82, in one embodiment, includes a coil spring 84 disposed around the spindle 60 of each roller 56 and 58 and connected thereto by the insertion of one end of the spring 84 through a bore 85 formed in the spindle 60. The opposite end of each spring 84 is connected to the outer shaft 76 in a bore 86 such that the springs 84 provides a point of connection between the spindle 60 and the outer shaft 76. The respective springs 84 within each roller 56, 58 have different spring rates such that the tension applied by spring 84 mounted to the take-up roller 58 is greater than the tension applied by spring 84 to the supply roller 56. The differential in the spring rate of respective spring 84 causes an overall rotational bias in the device 20 towards the take-up roller 58. In other words, the differential in the spring rate of the springs 84 causes the web 94 to be continually drawn from the supply roller 56 onto the take-up roller 58.

Figure 5:
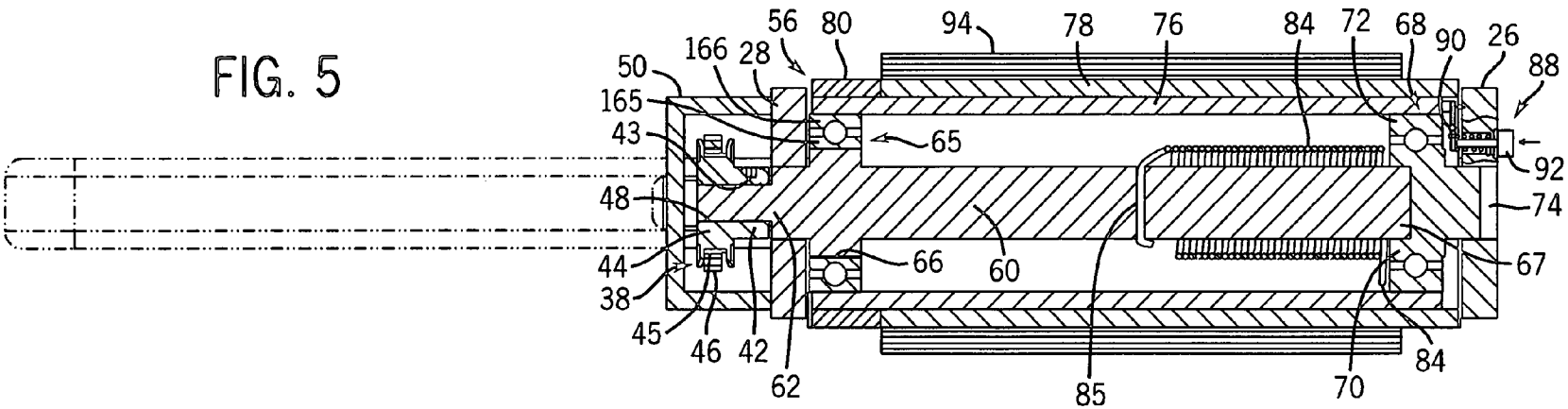
FIG. 5 is a cross-sectional view along line 5-5 of FIG. 3.

This bias towards the take-up roller 58 is opposed by a braking mechanism 88, best shown in FIG. 5 that is operatively connected to the take-up roller 58. The braking mechanism 88 includes a braking member 90 that contacts the outer member 72 and/or outer shaft 76 of the take-up roller 58 to provide a resistive force to the rotation of the supply roller 56 that, in combination with the spring 84 in the supply roller 56, makes the effective spring rate or the tension applied to the supply roller 56 and take-up roller 58 is essentially equal. Thus, when the braking member 90 is engaged with the take-up roller 58, the rotation of the rollers 56, 58 is controlled by the pulleys 38, 40 and the belt 46. The mechanism 88 also includes a switch 92 that, when depressed, operates to disengage the braking member 90 from the take-up roller 58, allowing the difference in the spring rates between the springs 84 to affect the station of the rollers 56, 58, causing the take-up roller 58 to draw the web 94 of the supply roller 56 and expose a clean unused section of the web 94. Alternatively, the braking mechanism 88 can be engaged with the supply roller 56 to provide the same function.

Figure 6:
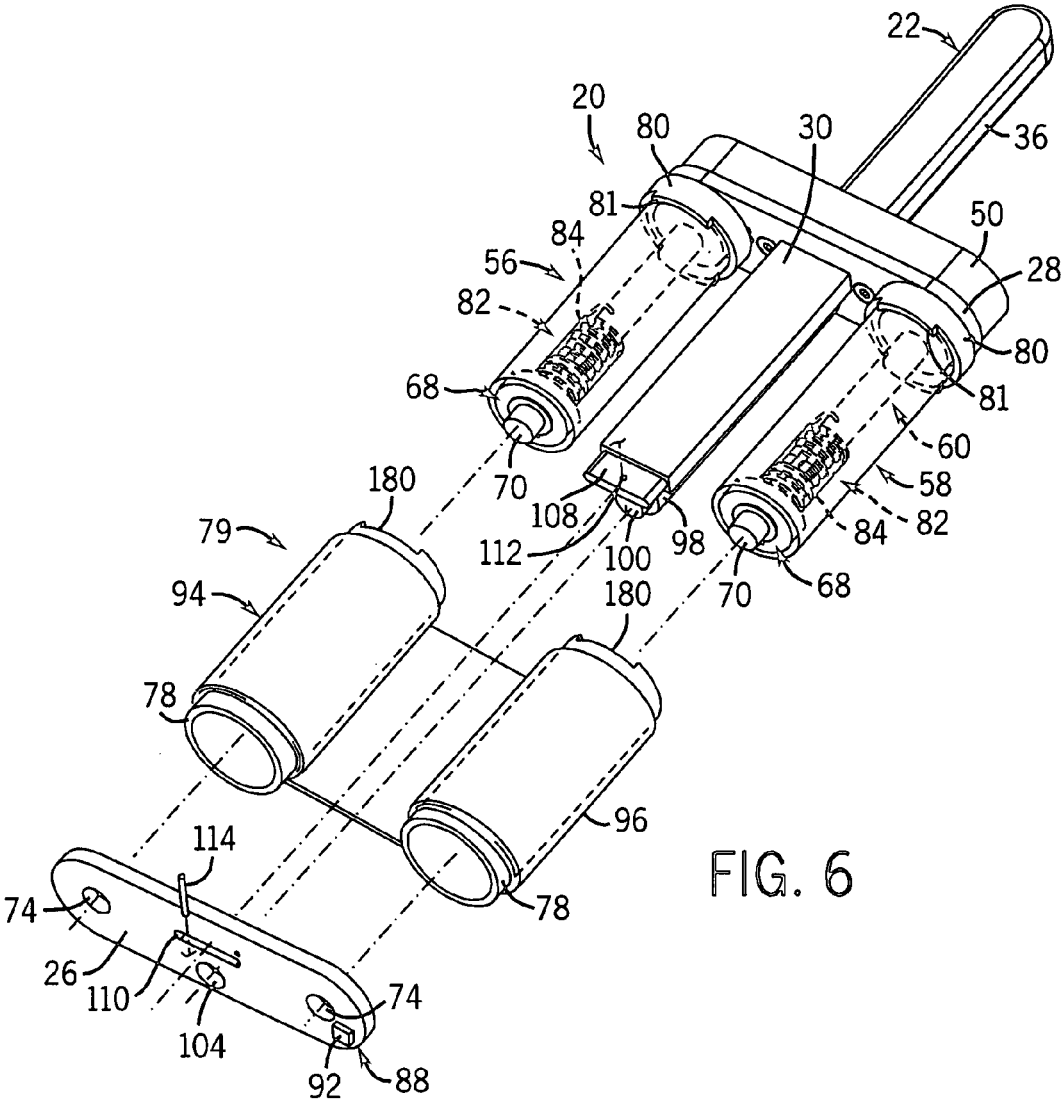
FIG. 6 is an exploded isometric view of the device of FIG. 3.
Figure 7:
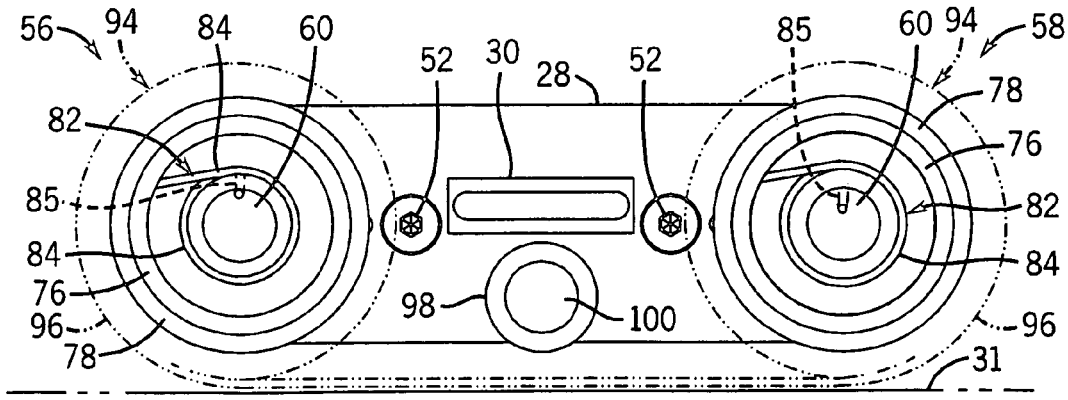
FIG. 7 is a cross-sectional view along line 7-7 of FIG. 3.

Referring now to FIGS. 6-7,the tension applied to the web 94, in addition to being provided by the respective springs 84 and braking mechanism 88 engaged with the rollers 56, 58, is also provided by a guide or idler roller 98 extending between the front plate 26 and the rear plate 28 directly beneath the central support 30. The guide roller 98 includes a pair of reduced diameter end portions 100 and 102 that can be rotatably or fixedly received within a pair of aligned apertures 104 and 106 in the front plate 26 and rear plate 28, respectively, such that the guide roller 98 can rotate freely with respect to the front wall 26, rear wall 28 and rollers 56, 58. The guide roller 98 contacts the non-tackified surface of the web 94 as it is moved between the rollers 56,58 in order to ensure sufficient contact of the tackified surface 96 with the surface being cleaned.

Looking now at FIGS. 1-4 and 6, in order to enable the web cartridge 79 including the sleeves 78 and the web 94 to be removed and replaced once the entire length of the tackified surface 96 of the web 94 has been utilized, the central support 30 is releasably secured to the front plate 26 by an end tab 108 extending outwardly from the central support 30 opposite the rear plate 28 and inserted through a slot 110 in the front plate 26. The tab 108 includes an opening 112 extending through the tab 108 generally perpendicularly to the tab 108 that receives a locking pin 114 therein. The pin 114 is engaged with the front plate 26 on opposite sides of the tab 108 to prevent the tab 108 from moving through the slot 110 and disengaging the central support 30 from the front plate 26. However, when it is desired to replace the web cartridge 79, the pin 114 is removed from the opening 112, such that the tab 108 can be disengaged from the slot 110 by sliding the front plate 26 off of the tab 108. The front plate 26 is simultaneously disengaged from the end portion 100 of the guide roller 98 and the second end 67 of each spindle 60, thereby allowing the front plate 26 to be completely removed from the device 20 and enabling the sleeves 78 and web 94 to be slid off of the outer shafts 76 of the rollers 56, 58 and replaced.

To operate the device 20, first the sleeves 78 supporting the web 94 are mounted to the respective outer shafts 76 for the supply roller 56 and take-up roller 58. The equalized tension applied through the respective rollers 56 and 58 to the web 94 by the springs 84 and the braking mechanism 88 allows the rollers 56 and 58 to be moved synchronously in both the clockwise and counterclockwise directions under the direction of the pulleys 38, 40 and the belt 46. Thus, the tackified surface 96 of the web 94 can be applied in long swipes to the selected surface to pickup lint, dust and other debris disposed on the surface. When it is desired to advance the web 94 a certain length to expose a clean portion of the tackified surface 96 of the web 94, the switch 92 of the braking mechanism 88 is depressed to disengage the braking member 90 from the supply roller 56. This allows the greater spring rate of the spring 84 within the take-up roller 58 to overcome the bias of the spring 84 in the supply roller 56, and draw the web 94 off of the supply roller 56 onto the take-up roller 58. After a desired length of the web 94 has been moved onto the take-up roller 58, the switch 92 is released such that the braking member 90 reengages the supply roller 56, again equalizing the tension applied to the rollers 56 and 58.

Figure 8:
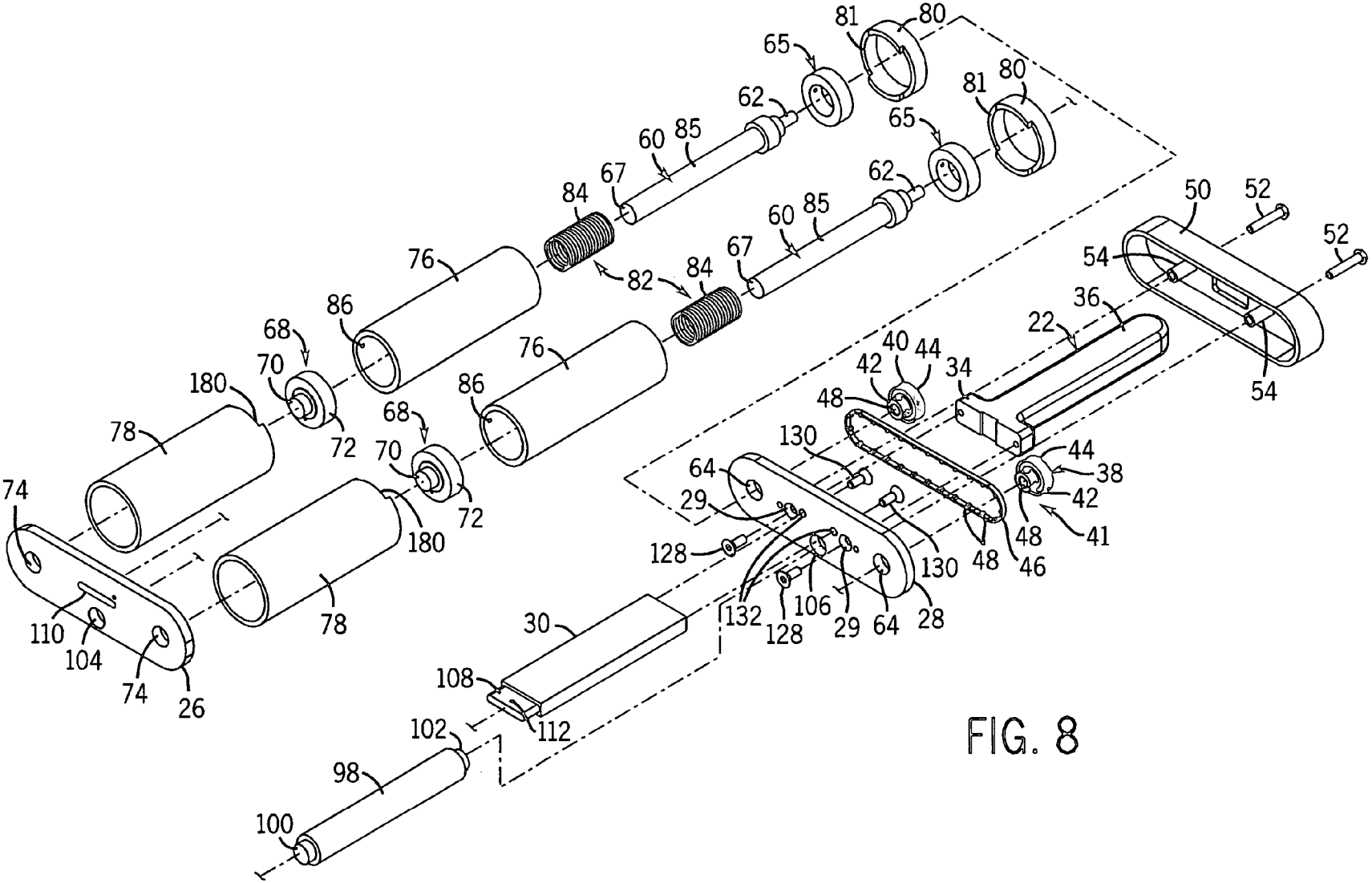
FIG. 8 is an exploded, isometric view of the device of FIG. 3.
Figure 9:
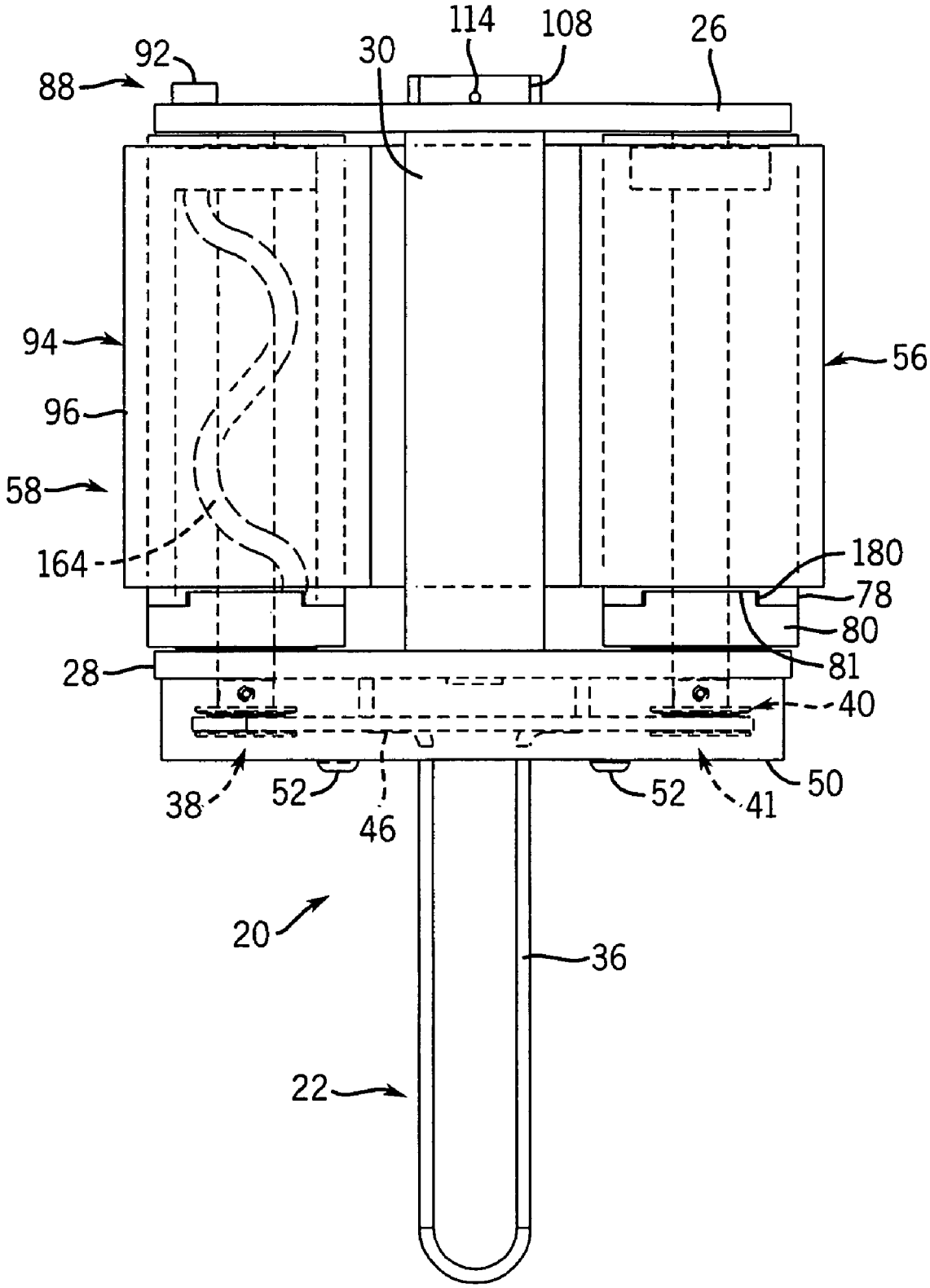
FIG. 9 is a top plan view of a second embodiment of the device of FIG. 3.

In addition to the above-described preferred embodiment of the device 20, other modifications to the device 20 are considered to be within the scope of the present invention. More specifically, as best shown in FIGS. 8 and 9, while the preferred embodiment discussed previously has disclosed the use of two springs 84 within the rollers 56, 58, it is also contemplated that a single biasing mechanism 82 with a single spring 84 can be positioned within one of the rollers 56 or 58. In this embodiment, the roller not including the biasing mechanism 82 has the outer shaft 76 fixedly connected to the spindle 60, or the spindle 60 can be omitted such that the spacer bearing 65 includes a stub shaft (not shown) that is engaged with the respective pulley 38, 40. Also, the biasing mechanism 82 can take other forms, such as a clutch-based mechanism.

The biasing member 84, in addition to being formed as a coil spring, can be formed of an elastomeric strip 164 secured between the spindle 60 and the outer shaft 76 of the take-up roller 58. The strip 164 functions identically to the coil spring 84 to rotationally bias the device 20 towards the take-up roller 58 to provide the web advancement function for the device 20. The elastomeric strip 164 can also take the place of one or both coil springs 84 in the embodiment for the device shown in FIGS. 1-7. The strips 164 can be selected to have different durometer values, such that the strip 164 used in the take-up roller 58 has a higher durometer value than the strip 164 in the supply roller 56, providing the bias towards the roller 58. Additionally, in the embodiment of the device 20 where only one biasing mechanism 82 is utilized, whether formed with a coil spring 84 or elastomeric strip 164, the braking mechanism 88 can be engaged with either roller 56 or 58.

Also, with regard to the synchronization mechanism 41 utilized in the device 20, in other alternative embodiments for the device 20, the placement of the pulleys 38, 40, belt 46 and cover plate 50 can be reversed such that the pulleys 38,40, belt 46 and cover plate 50 are secured to the front plate 26 with the handle 22 remaining attached to the rear plate 28. In this embodiment, the rear plate 28 can be made to be disengagable from the central support 30, where the front plate 26 remains attached to each of rollers 56, 58. Further, the mechanism 41 can take other forms as well, such as a clutch-based mechanism.

Further, concerning the materials used to form each of the various components of the device 20, these components are preferably formed of a generally rigid material that it is also preferably lightweight, with the exception of belt 46 and the elastomeric strip 164. Therefore, the materials capable of being utilized for each of the components of the device 20 include metals, and plastics, which are strong and lightweight materials capable and utilized in devices of the above-described type.

Figure 10:
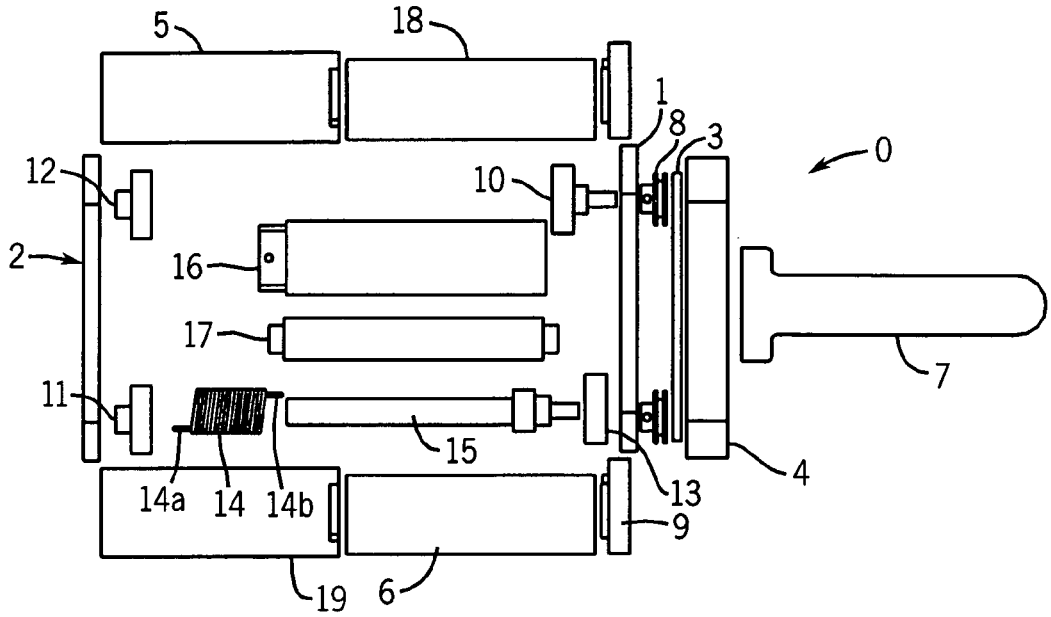
FIG. 10 is an exploded view of a third embodiment of the device of FIG. 1.
Figure 11:
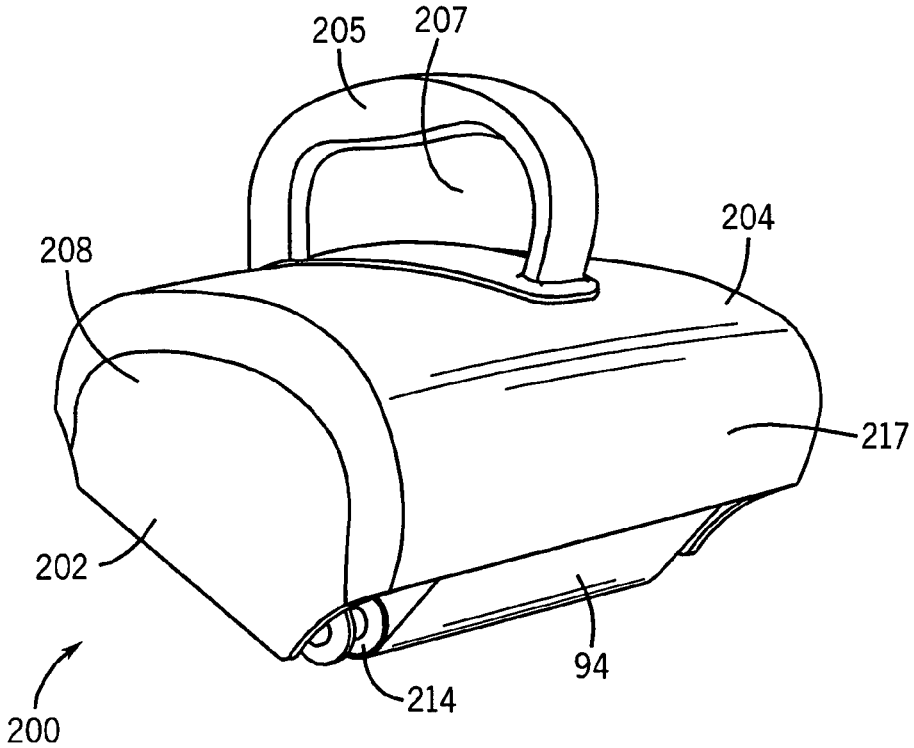
FIG. 11 is a perspective view of a fourth embodiment of the device of FIG. 1.
Figure 12:
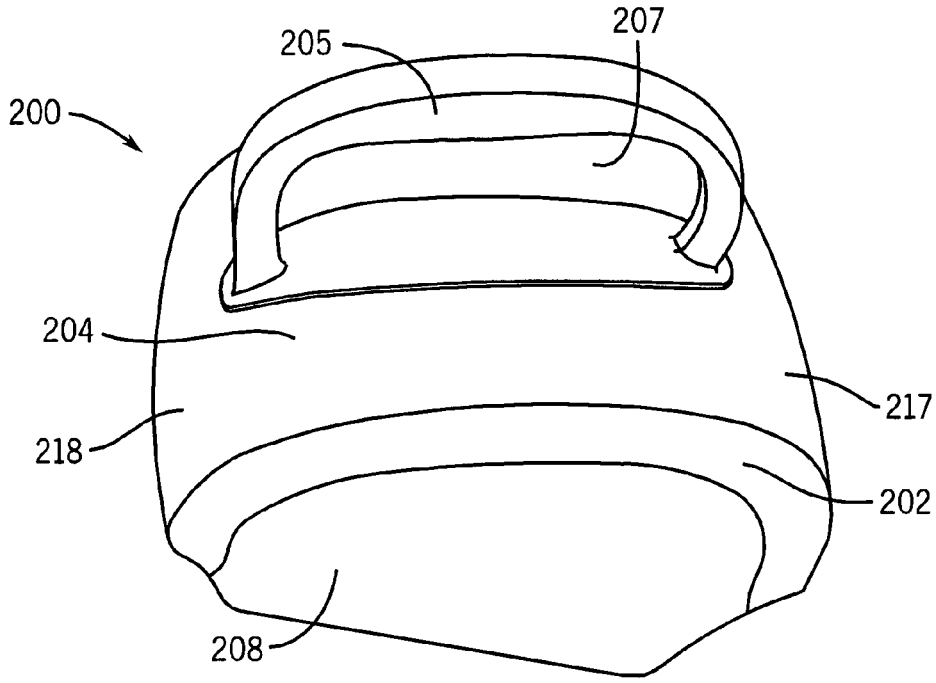
FIG. 12 is an isometric view of the device of FIG. 11.

Referring now to FIG. 10, item 1 attachment plate A contains two journal bearing holes, and item 2, attachment plate B contains two journal bearing holes that align with item 1, Items 8, two timing belt pulleys with the same pitch diameter communicate rotational position and force by item 3, timing belt. Item 10, a shaft and roll end plate rides in journal bearing of item 1 and fastens to item 8 transferring rotation position and force to item 18, direct driven roll, take-up roll for one direction of travel of item 0, 2-roll lint roller device. Item 12, free roll end plate is attached to the an end of item 18 direct driven roll and is held in alignment by journal bearing of item 2, attachment plate B. Item 5, core tube is used for the collection of lint tape that is dirty. The core tube is replaced and communicates with the item 18 by friction.

Item 15, a shaft rides in journal bearings of item 1 and item 2, attachment plates A and B. Item 15, shaft is fastens to item 8, timing belt pulley that rotates in unison with item 18, direct driven roll through item 3, timing belt. Item 13, roll end plate rides is a journal for item 15, shaft is pressed into item 6, spring driven roll. Item 14*a*, torsion spring arm passing through center as a straight cylinder at one end of item 14, torsion spring passes through a slot to transfer rotation position and force from item 15, shaft to item 14 torsion spring. Item 14*b*, torsion spring arm extends radial on the opposite end of item 14, torsion spring attaches to item 11, roll end plate rides is a journal for item 15, shaft is pressed into item 6, spring driven roll.

Item 19, core tube is used for the supply lint tape that is clean. The core tube containing new lint tape is replaced and communicates with the item 6 by friction. Lint tape communicates tension force and surface distance between items 19 and 5. The rotational position of item 11, roll end plate corresponds to the rotation position of item, 19, core tube. The accumulative difference in rotation position between items 14*b* and 14*a*, torsion spring arms of item 14, torsion spring is taken up by increasing or decreasing the turns from free state applied to item 14, prior to installing item 3, timing belt.

Item 4, belt cover is attached to item 1, attachment plate A and to item 7, handle. Item 16, support post attaches items 1 and 2, attachment plates A and B together. Item 17, support roller may be used to insure that item, lint tap is pressed against surface to be cleaned. Journals to support item 17 are needed in items 1 and 2, attachment plates.

A two-roll lint roller replacement assembly (not shown) consists of a wrapper holding item 5, an empty core tube and item 19, a full core tube or item, lint tape and item 2, attachment plate B completes the assembly. A feature also contemplated is to accept and lock item forming part 9 of a brake linkage that is moved out of the trapping feature of item 2 before two-roll lint roller replacement assembly can be attached to item 0, two-roll lint roller device. In this feature, a brake plate 9 is attached to the brake linkage so that when the linkage is move to allow replacement of the tape web, the brake 9 presses against 18, direct driven roll and 6, spring driven rolls. The pivot axis of the linkage communicates with the support structure of item 0, two-roll lint roller device.

Referring now to FIGS. 11-15, a fourth embodiment for the device 200 includes a housing 202 having an upper surface 204 and a pair of downwardly extending side panels 206 and 208. The housing 202 also includes a handle 205 that is positioned on the upper surface 204 between the side walls 206, 208 to extend generally parallel to the side walls 206, 208. The handle 205 can have any desired shape or configuration, e.g., the handle can also be oriented perpendicular to the walls 206, 208, but in this embodiment takes the form of a generally U-shaped bar connected to the surface 204 at opposite ends and defining a space 207 between the handle 205 and the surface 204.

Within the housing 202, a roller mechanism 209 is disposed which includes a pair of plates 210, 212, which are generally triangular in shape but which can have any shape desired or required, that are releasably secured to and extend parallel to the side walls 206 and 208. One plate 210 includes a synchronization mechanism 41 disposed between the plate 210 and side wall 206, which is formed as discussed previously, and which is connected to a supply roller 56 and a take-up roller 58 rotatably mounted between the plates 210 and 212, which are also formed and rotatably mounted to the plates 210, 212 in the manner previously discussed regarding FIGS. 1-10. A pair of idler rollers 214 and 216 is also rotatably mounted between the plates 210 and 212 between the supply roller 56 and take-up roller 58 in a manner similar to the mounting of guide roller 98. The idler rollers 214, 216 each include edge guides 215 disposed on opposite ends of each roller 214, 216 to properly align the web 94 as it moves around the rollers 214, 216.

Figure 13:
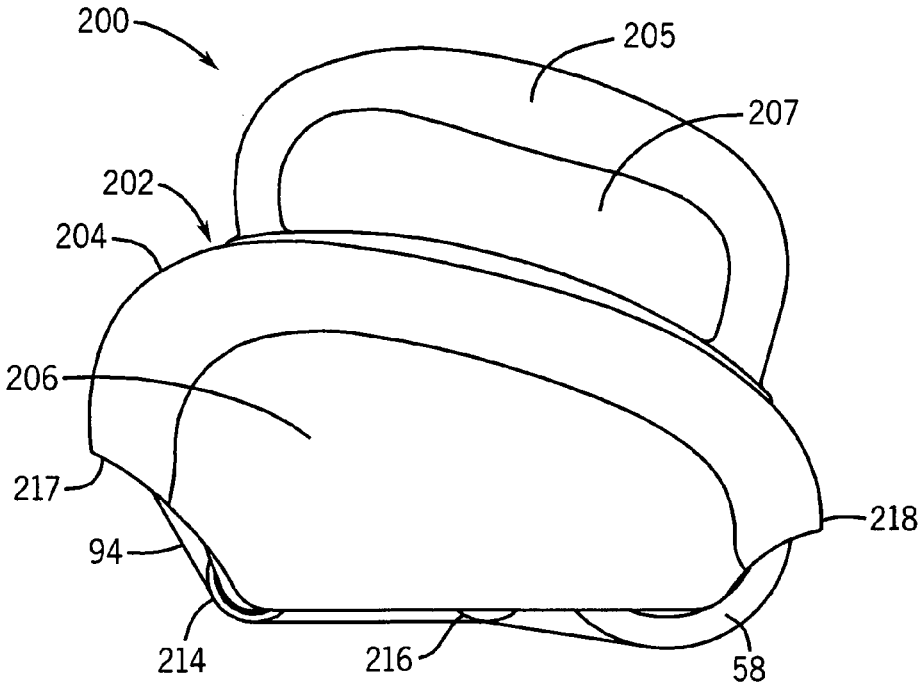
FIG. 13 is a side plan view of the device of FIG. 11.
Figure 14:
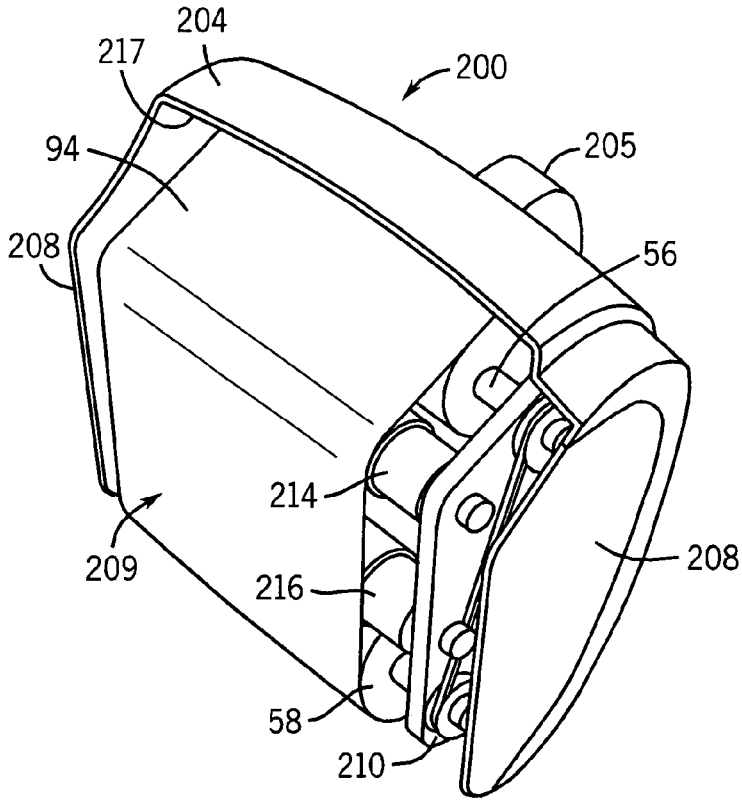
FIG. 14 is a bottom perspective view of the device of FIG. 11.
Figure 15:
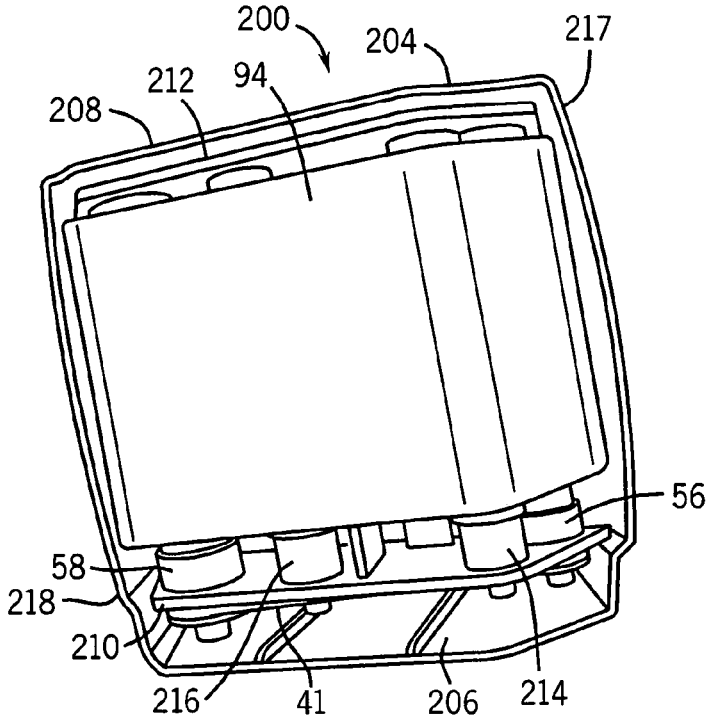
FIG. 15 is a bottom plan view of the device of FIG. 11.
Figure 16:
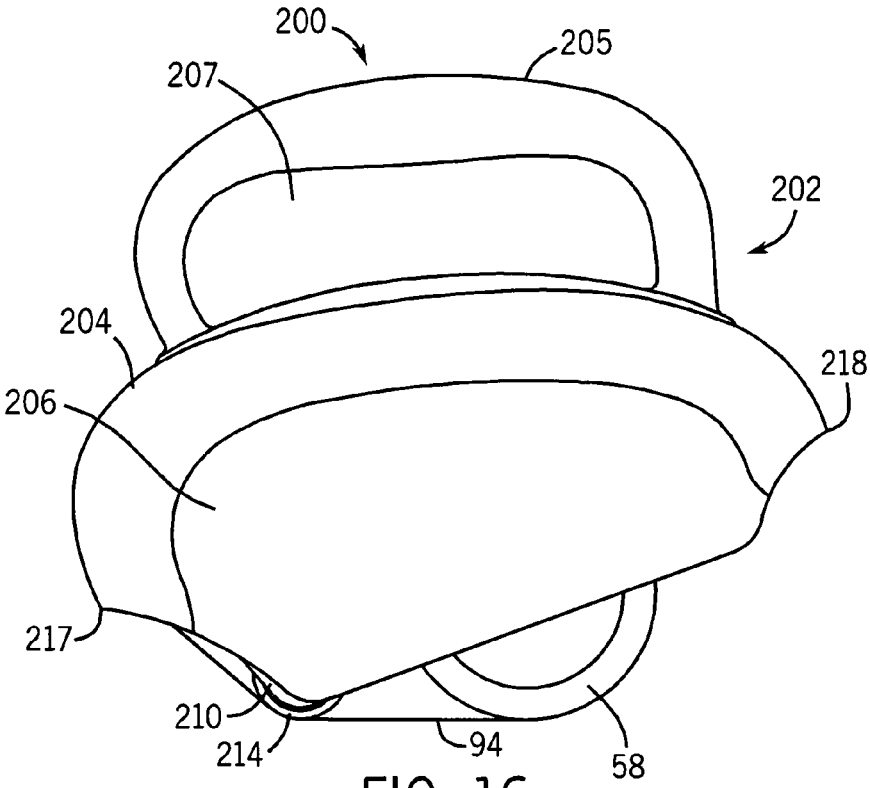
FIG. 16 is a side plan view of a fifth embodiment of the device of FIG. 1.
Figure 18:
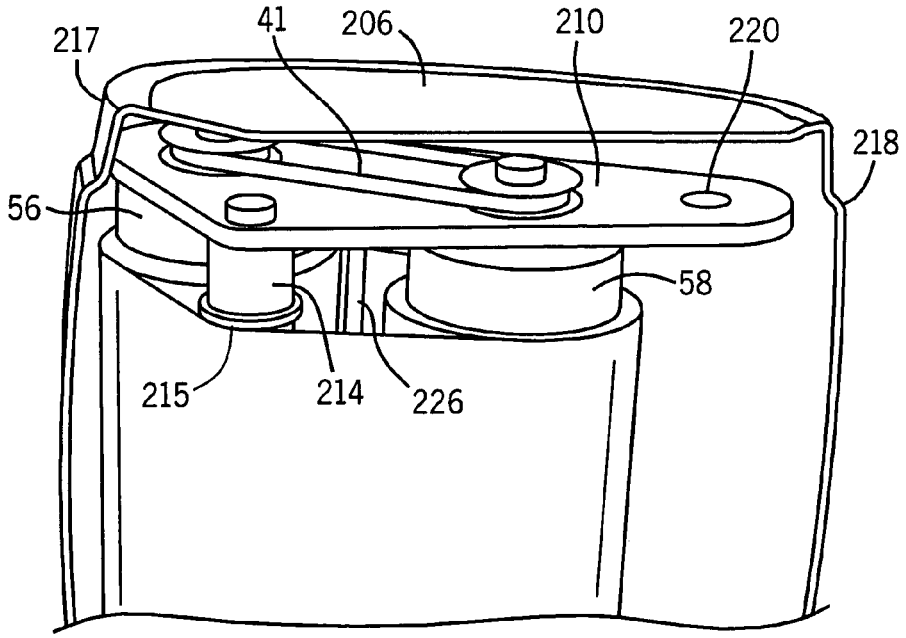
FIG. 18 is a partially broken away bottom plan view of the device of FIG. 16.
Figure 17:
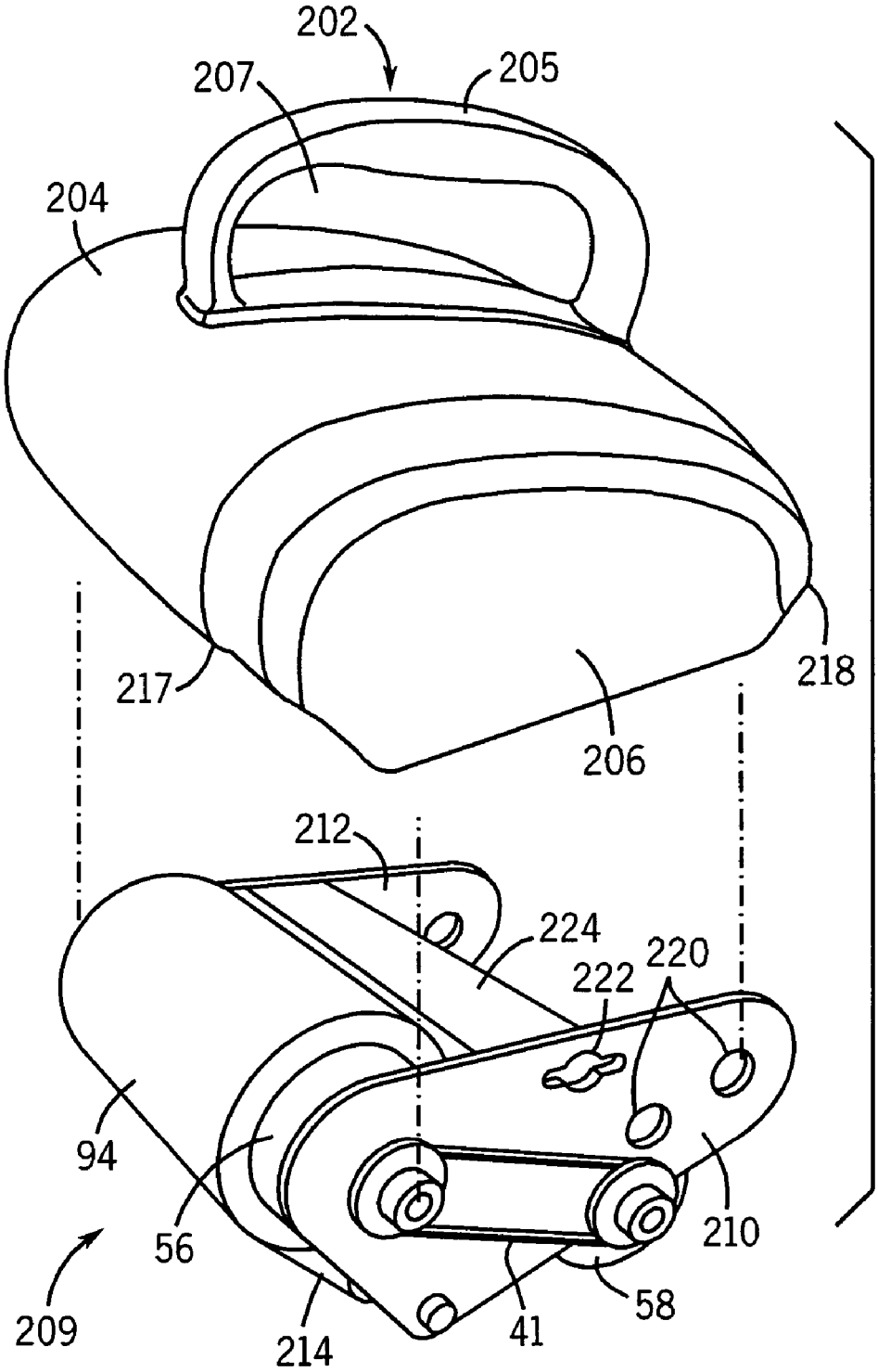
FIG. 17 is a partially exploded, perspective view of the housing and tape cartridge of the device of FIG. 16.
Figure 19:
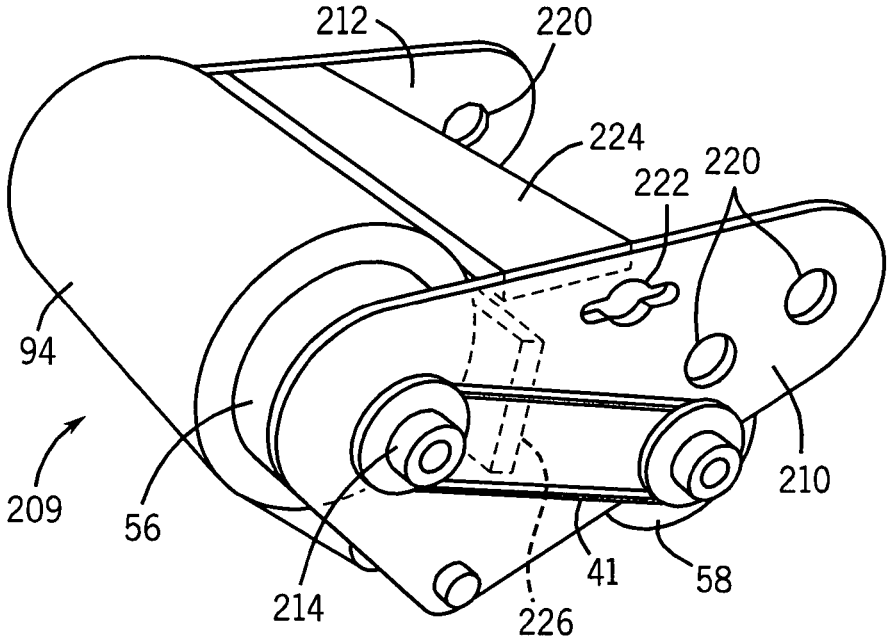
FIG. 19 is a perspective view of the tape cartridge of FIG. 17.
Figure 20:
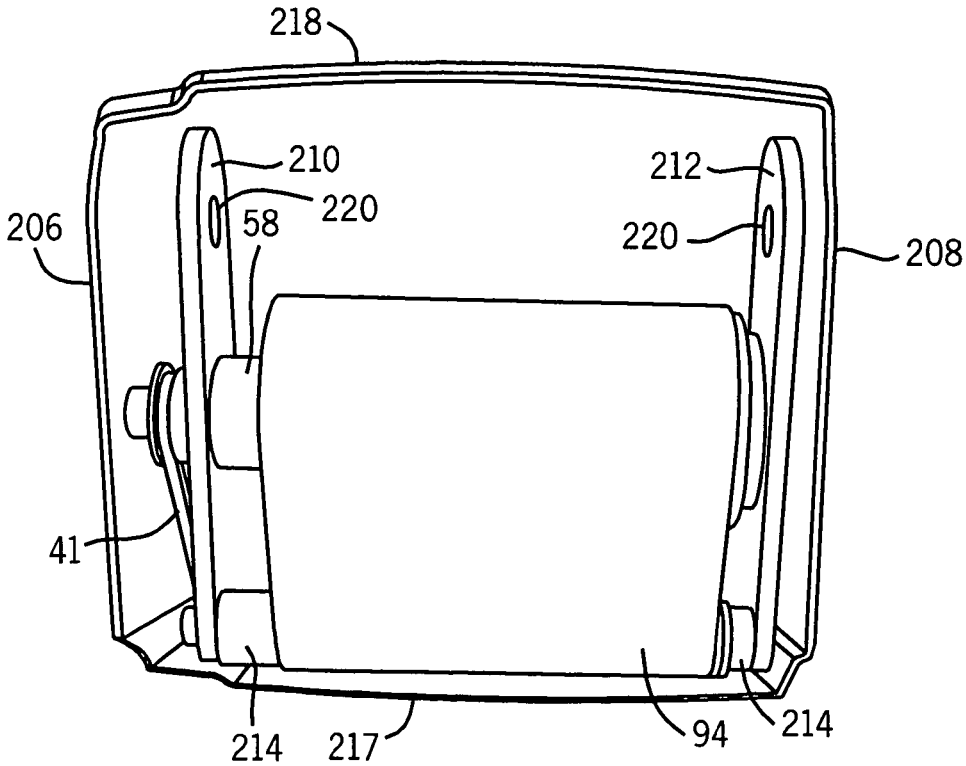
FIG. 20 is a bottom plan view of the device of FIG. 18.
Figure 21:
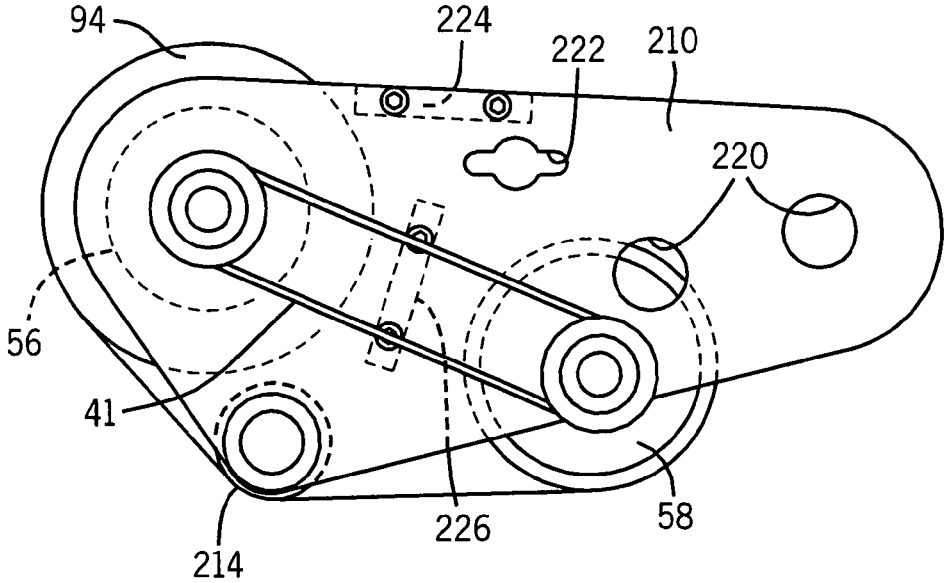
FIG. 21 is a side plan view of the tape cartridge of FIG. 17.
Figure 22:
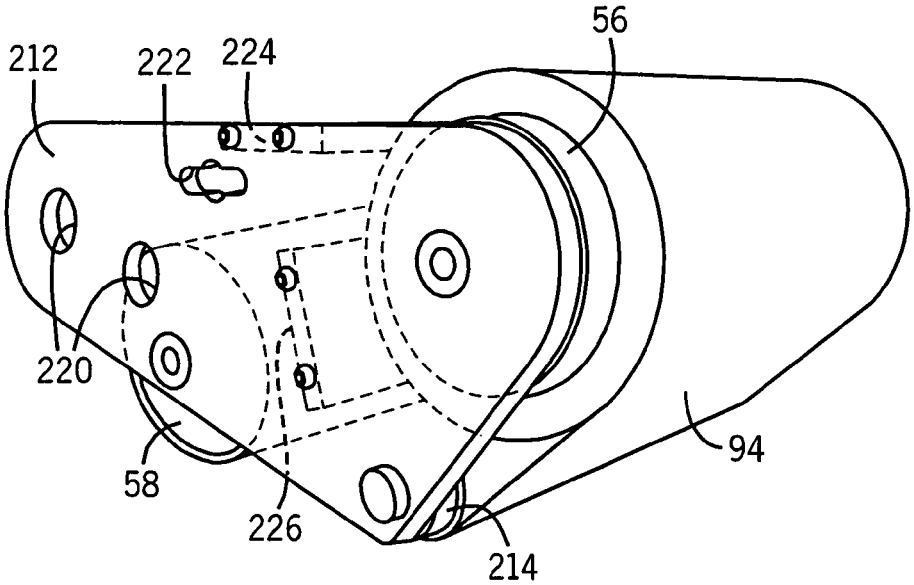
FIG. 22 is a perspective view of the tape cartridge of FIG. 17.

In this embodiment, the supply roller 56 is disposed adjacent a front end 217 of the housing 202 in a position where the roller 56 is completely contained within the housing 202. The take-up roller 58 is disposed adjacent the rear end 218 of the housing 202 and is positioned such that a lower portion of the roller 58 protrudes outwardly from the housing 202 below the lower edge of the side walls 206 and 208. The idler rollers 214 and 216 are also mounted in a rotatable manner to the plates 210, 212 such that each of the rollers 214, 216 projects outwardly from the housing 202 below the side walls 206, 208. The positioning of the idler rollers 214 and 216, and take-up roller 58 ensures that the adhesive web 94 extending between the supply roller 56 and take-up roller 58 is directed outwardly from the housing 202 in a manner which can adequately contact the surface to be cleaned between the front idler roller 214 and the take-up roller 58. Additionally, as best shown in FIG. 13, the take-up roller 58 can be positioned such that the take-up roller 58 protrudes outwardly from the housing 202 further than the idler rollers 214 and 216 in order to focus the contact of the adhesive web 94 with the surface to be cleaned in an area adjacent the take-up roller 58.

Referring now to FIGS. 16-22, a fifth embodiment for the device 200 is illustrated in which only a single idler roller 214 is rotatably positioned between the supply roller 56 and the take-up roller 58. The take-up roller 58 is also moved forwardly within the housing 202 towards the supply roller 58 in order to provide a generally planar contact surface section for the web 94 between the idler roller 214 and the take-up roller 58. The plates 210, 212 are also shown to have multiple bores 220 in which the take-up roller 58 and idler rollers 214, 216 can be mounted to form the various embodiments for the device 200, as well as a pair of mounting openings 222, used to releasably secure the plates 210, 212 within the housing 202. A pair of supports 224, 226 is also shown extending between the plates 210, 212 to provide stability to and ensure proper connection between the rollers 56, 58, 214 and the plates 210, 212.

Figure 23:
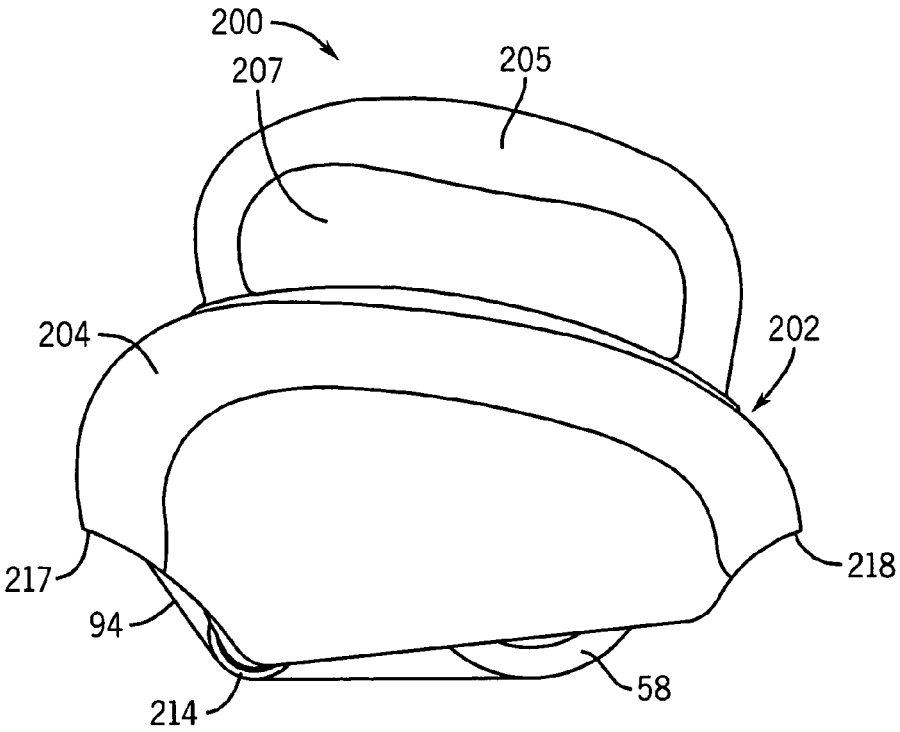
FIG. 23 is a side plan view of a sixth embodiment of the device of FIG. 1.
Figure 24:
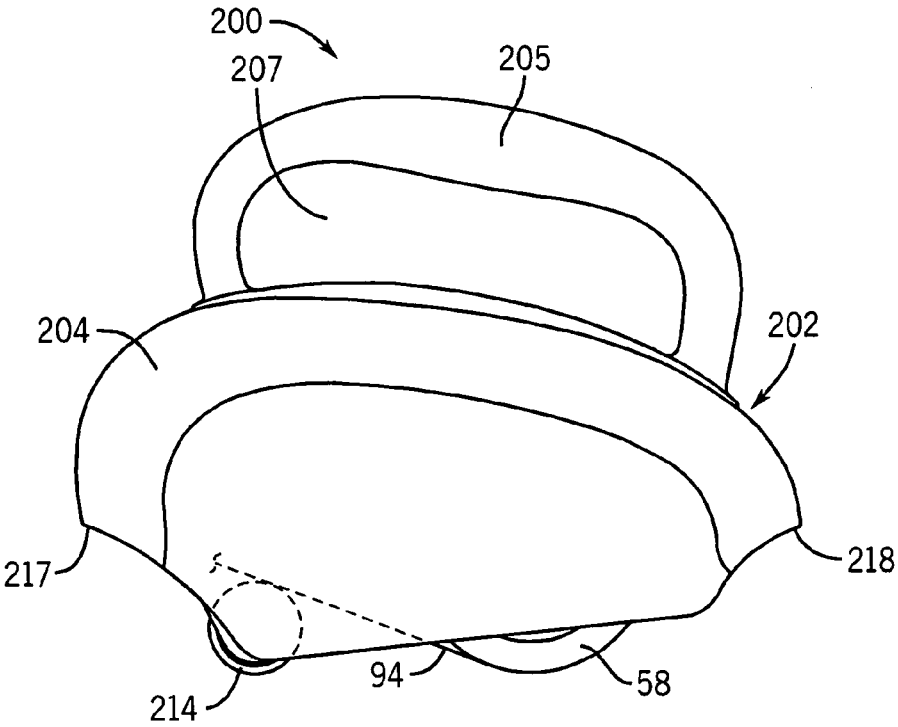
FIG. 24 is a side plan view of a seventh embodiment of the device of FIG. 1.

A sixth embodiment for the device 200 is illustrated in FIG. 23 in which the idler pulley 216 is removed from between the plates 210, 212, similar to the embodiment in FIGS. 16-22, such that a web contact surface section is formed between the front idler pulley 214 and the take-up roller 58. However, the take-up roller 58 in this embodiment is moved only slightly forward from the rear end 218 in order to increase the size of the contact surface section of the web 94 extending between the front idler pulley 214 and the take-up roller 58. This contact area, similar to that in the embodiment of FIGS. 16-22, assists in the balance of tension between the supply roller 56 and take-up roller 58. In this embodiment, similar to the embodiment of FIGS. 16-22, the handle 205 is positioned directly over the take-up roller 58 to more directly apply the force exerted on the handle 205 by the user to the web 94 and surface to be cleaned. In FIG. 24 illustrating a seventh embodiment of the device 200, the middle idler roller 216 is removed as well, but the web 94 is directed above or behind the front idler pulley 214 directly between the supply roller 56 and the take-up roller 58. Thus, the contact between the adhesive web 94 and the surface to be cleaned occurs only at the lower most point on the outer diameter of the take-up roller 58.

Various alternatives are contemplated as being within the scope of the following claims particularly pointing out and distinctly claiming the subject matter regarded as the invention.

What is claimed is:

1. A cleaning device comprising:

a) a manually grippable support:

b) a pair of rollers adapted to movably support a web of adhesive material between the rollers and rotatably connected to the support, at least one of the pair of rollers including an inner shaft rotatably connected to the support, and an outer shaft rotatably connected to the inner shaft and biasing member connected to the inner shaft and the outer shaft, wherein each of the pair of rollers includes an inner shaft rotatably connected to the support, an outer shaft rotatably connected to the inner shaft, and a biasing member connected between an inner shaft and an outer shaft, wherein the biasing members in each of the pair of rollers have different tensioning forces;

c) a roller synchronization mechanism connected between the pair of rollers and operable to rotate the pair of rollers in a synchronize manner; and d) a braking mechanism engaged with at least one of the pair of rollers.

2. The device of claim 1 wherein the braking mechanism comprises:

a) a braking member engageable with the at least one roller; and b) a switch connected to the braking member and actuatable to disengage the braking member from the at least one roller.

3. A cleaning device comprising:

a) a manually grippable support;

b) a pair of rollers adapted to movably support a web of an adhesive material between the rollers and rotatably connected to a first side of the support, at least one of the pair of rollers including an inner shaft rotatably connected to the support, and an outer shaft rotatably connected to the inner shaft and biasing member connected to the inner shaft and the outer shaft;

c) a roller synchronization mechanism connected between the pair of rollers and operable to rotate the pair of rollers in a synchronize manner; and d) a braking mechanism engaged with at least one of the pair of rollers.

4. The device of claim 3 wherein the braking mechanism is engaged with the at least one of the pair of rollers including the inner shaft, the outer shaft, and the biasing member.

5. A cleaning device comprising:

a) a support having a roller side and a handle side opposite the roller side;

b) a pair of rollers adapted to movably support a web of an adhesive material between the rollers and rotatably connected to the roller side of the support, at least one of the pair of rollers including an inner shaft rotatably connected to the support, and an outer shaft rotatably connected to the inner shaft and biasing member connected to the inner shaft and the outer shaft;

c) a roller synchronization mechanism connected between the pair of rollers and operable to rotate the pair of rollers in a synchronize manner;

d) a manually grippable handle connected to the handle side of the support and wherein the handle is centered on the handle side of the support such that the handle extends along an axis extending between the pair of rollers; and e) at least one idler roller disposed between the pair of rollers and rotatably connected to the support, the at least one idler roller adapted to tension and guide the web of adhesive material between the rollers.

6. A cleaning device comprising:

a) a housing including a front plate, a rear plate, a central support connected the front plate and the rear plate, and a cover releasably connected to the front plate and the rear plate;

b) a first roller connected between the front plate and the rear plate, the first roller including a first inner shaft rotatably connected between the front plate and the rear plate, a first outer shaft rotatably connected to the first inner shaft, and a first biasing member connected between the first inner shaft and the first outer shaft;

c) a second roller spaced from the first roller including a second outer shaft and rotatably connected between the front plate and the rear plate;

d) a roller synchronization mechanism connected to the first roller and the second roller;

e) an adhesive web cartridge secured to each of the first roller and the second roller; and f) a braking member engaged with one of the first roller or the second roller.

7. The device of claim 6 wherein the braking mechanism comprises:

a) a braking member engageable with one of the first roller or the second roller; and b) a switch connected to the braking member and actuatable to disengage the braking member from the first roller or the second roller.

8. A cleaning device comprising:

a) a housing including a front plate, a rear plate, a central support connected the front plate and the rear plate, and a cover releasably connected to the front plate and the rear plate;

b) a first roller connected between the front plate and the rear plate, the first roller including a first inner shaft rotatably connected between the front plate and the rear plate, a first outer shaft rotatably connected to the first inner shaft, and a first biasing member connected between the first inner shaft and the first outer shaft;

c) a second roller spaced from the first roller including a second outer shaft and rotatably connected between the front plate and the rear plate;

d) a roller synchronization mechanism connected to the first roller and the second roller; and e) an adhesive web cartridge secured to each of the first roller and the second roller;

wherein the first biasing member is a spring.

* * * * *